US011801978B2

(12) United States Patent
Savenok

(10) Patent No.: US 11,801,978 B2
(45) Date of Patent: Oct. 31, 2023

(54) CONTAINER LID ASSEMBLY WITH DISPLACEABLE SLIDER ELEMENT

(71) Applicant: Pavel Savenok, Wheaton, IL (US)

(72) Inventor: Pavel Savenok, Wheaton, IL (US)

(73) Assignee: Resolute Patents, LLC, Wheaton, IL (US)

( * ) Notice: Subject to any disclaimer, the term of this patent is extended or adjusted under 35 U.S.C. 154(b) by 581 days.

(21) Appl. No.: 16/874,158

(22) Filed: May 14, 2020

(65) Prior Publication Data

US 2020/0270029 A1 Aug. 27, 2020

Related U.S. Application Data

(62) Division of application No. 15/657,121, filed on Jul. 22, 2017, now Pat. No. 10,654,626.

(51) Int. Cl.
*B65D 43/02* (2006.01)
*B65D 43/26* (2006.01)

(52) U.S. Cl.
CPC ..... *B65D 43/0218* (2013.01); *B65D 43/02* (2013.01); *B65D 43/26* (2013.01); *B65D 2543/0024* (2013.01); *B65D 2543/00046* (2013.01); *B65D 2543/00953* (2013.01)

(58) Field of Classification Search
CPC .... B65D 43/0218; B65D 43/02; B65D 43/26; B65D 2543/00046; B65D 2543/0024; B65D 2543/00953
USPC ..... 220/254.9, 345.4, 715; 222/561
See application file for complete search history.

(56) References Cited

U.S. PATENT DOCUMENTS

| | | | | |
|---|---|---|---|---|
| 2,202,653 | A * | 5/1940 | Glidden | A61M 5/3205 220/253 |
| 3,792,803 | A * | 2/1974 | Kessler | B65D 47/286 220/348 |
| 4,074,827 | A | 2/1978 | Labe, III | |
| 4,570,817 | A * | 2/1986 | Hambleton | B65D 47/286 220/345.2 |
| 7,357,272 | B2 | 4/2008 | Maxwell | |
| 7,591,389 | B2 * | 9/2009 | Wong | B65D 47/32 220/780 |
| 7,845,510 | B2 * | 12/2010 | Schmidtner | B65D 47/286 220/717 |
| 9,238,529 | B1 * | 1/2016 | Newman | B65D 43/12 |

(Continued)

*Primary Examiner* — James N Smalley
(74) *Attorney, Agent, or Firm* — Christopher J. Scott

(57) ABSTRACT

A container lid assembly outfits a container includes a lower lid construction and a slider element. The slider element is received in the lower lid construction and is linearly displaceable in a back and forth manner relative to the lower lid construction for opening and closing the container lid. The lower lid construction includes concave surfacing and the slider element includes convex surfacing. The slider element seats atop the lower lid construction such that the convex surfacing and concave surfacing form a spherical surface-to-surface seal and enabling slidable open-close functionality. The slider element is resiliently actuable when seated atop the lower lid construction for enhancing seated engagement therebetween. The slider element includes a step-down formation cooperable with resilient actuation thereof for further enhancing seated engagement between the slider element and the lower lid construction. The container lid further locks to the container when in an actuated lower lid configuration.

6 Claims, 25 Drawing Sheets

(56) References Cited

U.S. PATENT DOCUMENTS

| | | | | |
|---|---|---|---|---|
| 9,617,046 | B1 * | 4/2017 | Sato | B65D 43/20 |
| 2005/0023183 | A1 | 2/2005 | Banik et al. | |
| 2006/0113313 | A1 | 6/2006 | Maravich et al. | |
| 2006/0180028 | A1 | 8/2006 | Burchard | |
| 2006/0201945 | A1 * | 9/2006 | Tedford | B65D 47/286 229/404 |
| 2008/0011762 | A1 | 1/2008 | Boone | |
| 2008/0073342 | A1 * | 3/2008 | Cai | B65D 47/286 220/780 |
| 2008/0073343 | A1 * | 3/2008 | Shadrach | B65D 47/286 220/780 |
| 2011/0068105 | A1 | 3/2011 | Pohlman et al. | |
| 2012/0312816 | A1 * | 12/2012 | Barreto | B65D 47/286 220/254.9 |
| 2014/0117016 | A1 * | 5/2014 | Hodge | B65D 41/62 220/812 |

* cited by examiner

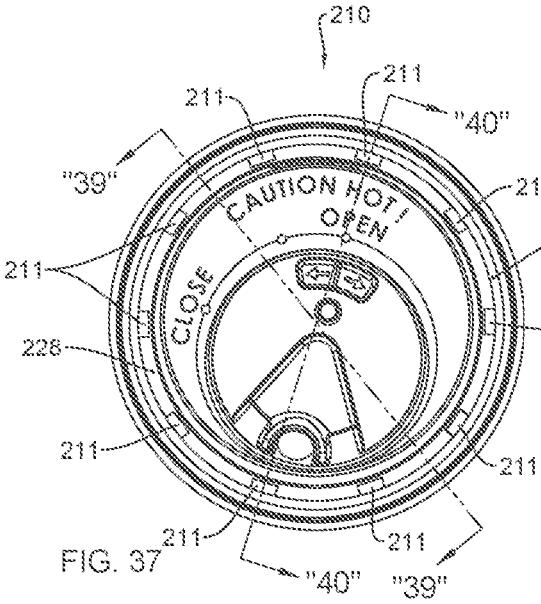
FIG. 37
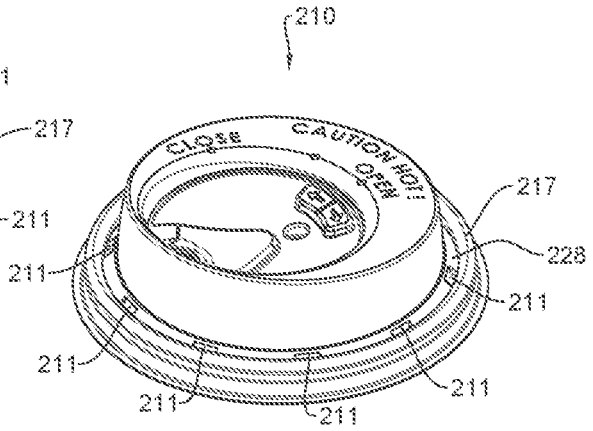
FIG. 38
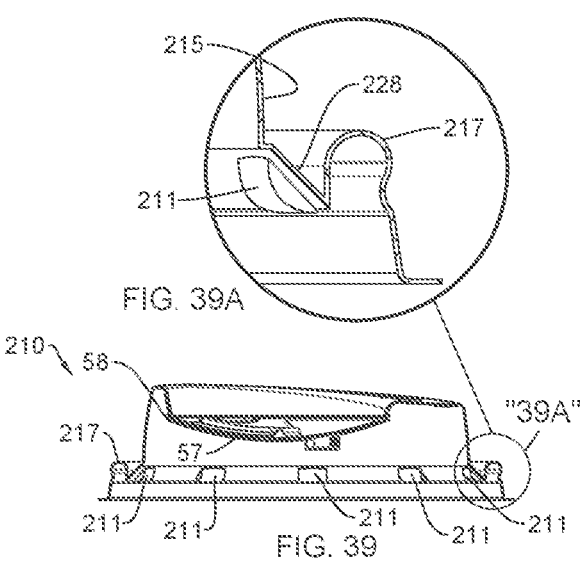
FIG. 39A
FIG. 39
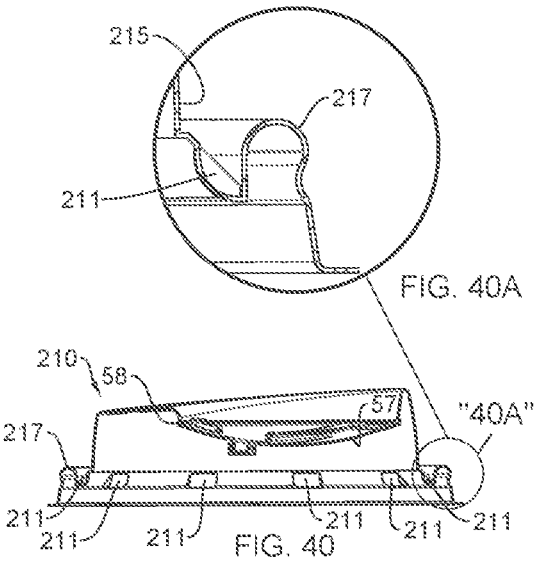
FIG. 40A
FIG. 40

213
233
234
226
216
225

"56A"
224
216
222

213
216
224

"55"
225
216
222
213
224
"56"
"56"

213
225
224
222
"54"
"54"

CONTAINER LID ASSEMBLY WITH DISPLACEABLE SLIDER ELEMENT

PRIOR HISTORY

This patent application is a divisional patent application from pending U.S. patent application Ser. No. 15/657,121 filed in the United States Patent and Trademark Office (USPTO) on 22 Jul. 2017 the specifications and drawings of which are hereby incorporated by reference thereto.

BACKGROUND OF THE INVENTION

Field of the Invention

The present invention generally relates to a container lid assembly and container-lid combinations, and more particularly to container-lid combinations operable to enhance lid-to-container retention or enhance the secured relationship of lids to containers, particularly with regard to drink container and lid combinations.

Brief Description of the Prior Art

U.S. Pat. No. 4,074,827 ('827 Patent), issued to Labe, III, discloses a Multi-Purpose Closure for a Container. The closure includes a base member having a central portion and a peripheral flange and a cover member also having a central portion and a peripheral flange. The cover member is adapted to be releasably secured to the base member such that when secured a cavity is formed between the respective members. The cavity is adapted for holding products, e.g., premiums or advertising material therein. Alternatively, a game or amusement device can be disposed within the cavity. To that end, in one embodiment of the invention the base member includes at least one recess and at least one ball adapted to fit within the recess to provide a game of skill. Means are provided, such as a cross-cut in the closure to enable a straw to be extended therethrough and into the container with the closure in place. A marginal portion is provided in one embodiment on the flange of the cover member to facilitate the separation of the cover member from the base member.

U.S. Pat. No. 7,357,272 ('272 Patent), issued to Maxwell, discloses a Ventable Container Assembly. The '272 Patent describes a ventable container including a container bottom having an inner cavity. The container bottom further has a side wall that terminates in a container rim, and a selectively detachable lid. The lid includes a central panel and peripheral sealing lip that surrounds the panel. The peripheral sealing lip has a generally inverted U-shaped cross-section that defines a lid channel adapted to receive the container rim, the lid channel being further adapted to position the lid at a first position wherein sealed engagement of the container is effectuated and at a first position relative to the container rim wherein an air passage from the inner cavity to the container surroundings is provided.

U.S. Pat. No. 9,238,529 ('529 Patent), issued to Newman et al., discloses a Lid for a Drink Cup. The '529 Patent describes a lid for a drink cup having a cover, and a slider, the slider engaged in sliding motion on the top of a disc of the cover. The disc has an aperture spaced apart from a flap. The slider is able to move to a position covering the aperture so as to prevent liquid from exiting the drink cup and, the slider is also able to move to a position to uncover the aperture to allow liquid to exit the drink cup. When the slider is positioned over the flap, the flap is forced to open slightly to allow air to enter the drink cup for venting action.

United States Patent Application Publication No. 2005/0023183, authored by Banik et al., describes a container for containing articles. The container comprises a first section and a second section. The first section is capable of engaging the second section to form a hermetic seal. The first section has a first cavity that is surrounded by a first peripheral wall and a peripheral edge. The first peripheral wall has a first surface that is angled toward the peripheral edge. The second section has a second peripheral wall that is capable of sliding between the first peripheral wall and the edge to form a hermetic seal.

United States Patent Application Publication No. 2006/0113313, authored by Maravich, et al., describes a liquid container comprising a brim forming an opening into a liquid reservoir chamber formed in the cup. A lid is coupled to the brim to form more than one seal with the container. The lid includes lid-removal blocker walls arranged to engage undercuts formed in the cup to retain the lid in a mounted position on the cup closing the opening into the liquid reservoir chamber.

United States Patent Application Publication No. 2006/0180028, authored by Burchard, describes a lid for a beverage container for holding a decoction beverage, preferably a disposable tea container with a base plate and a covering arranged at a distance from the base plate in which case between the base plate and the covering a holding space bounded on the sides by a surrounding side wall is formed. A first opening is provided in the base plate through which a decoction unit holding decoction materials can be guided and a second opening smaller than the first opening being formed in the covering or in the region of the covering through which a section of the decoction unit can be guided, the holding space being of dimensions such as to hold at least part of the decoction unit.

United States Patent Application Publication No. 2008/0011762, authored by Boone, describes a splash-proof cup lid that includes plural barriers disposed on the undersurface of the cup lid. The barriers are strategically positioned and uniquely configured to prevent liquid from sloshing through the drink opening when the cup is in an upright or slightly tilted position and is bumped or jarred. The barriers however, do not prevent the liquid from flowing through the drink opening when the cup is tilted to a drinking position.

United States Patent Application Publication No. 2011/0068105, authored by Pohlman et al., describes a container including a lid adapted to seal with a base. The lid and base rims each have vertical segments that mate upon sealing the container. The mating segments form a vertical seal zone. The vertical seal zone has a width extending across the rim surfaces. One or more vent channels are disposed on either or both rims. Each vent channel extends partially into the vertical seal zone. When pressure inside the container reaches a critical level, the lid rises and reduces the width of the seal zone, creating a vent point. Pressurized vapors traveling through the vent channel overcome rim-engaging forces at the vent point and pass through the engaged rims. Once pressure is purged, the lid descends and resumes its sealed arrangement with the base. The rims may respectively include horizontally oriented segments that engage each other to from a horizontal seal zone.

SUMMARY OF THE INVENTION

The primary objective of this invention is the provision of a number liquid lid-container combinations for maximizing lid-to-container retention or to prevent lids from becoming inadvertently removed from containers once outfitted thereupon. To achieve this basic objective, the present invention generally provides a liquid lid-container assembly or combination for maximizing lid-to-container retention or for maximizing container lid retention relative to the liquid container when outfitted thereupon. The liquid lid-container assemblies or combinations according to the present invention preferably comprise, in combination, a liquid container and a container lid as hereinafter variously exemplified and referenced.

The liquid container according to the present invention is believed to essentially and preferably comprise an upper container rim and a container wall extending downwardly from the upper container rim. Notably, the container wall comprises a first inner matable portion exemplified by a radially outwardly extending indentation or groove formed in inferior adjacency to the upper container rim. The container lid essentially comprises a rim-receiving groove, a radially inner and upright lid wall, and a skirt-like, wall-to-groove-traversing resilient portion.

The wall-to-groove-traversing resilient portion as variously referenced and exemplified traverses a structural distance between the upright lid wall and the rim-receiving groove and is resiliently actuable intermediate a relaxed configuration and an actuated configuration. The distance-traversing resilient portion comprises an outer second matable portion exemplified by a radially outer indentation-engaging portion as variously referenced.

The rim-receiving groove grip-receives the upper container rim, and the radially outer indentation-engaging portion grip-engages the radially outwardly extending indentation when in the actuated configuration when the container lid is outfitted upon the liquid container. Thus, the rim-receiving groove and the radially outer indentation-engaging portion together lock the container lid to the liquid container for cooperatively maximizing lid-to-container retention.

The upright, radially inner lid wall and wall-to-groove-traversing resilient portion are directable toward the liquid container from the relaxed configuration for reconfiguring the wall-to-groove-traversing resilient portion into the actuated configuration. The radially outer lid-locking bend or radially outer indentation-engaging portion is directable radially outwardly into engagement with the radially outwardly extending indentation when the wall-to-groove-traversing resilient portion is reconfigured into the actuated configuration.

Certain preferred optional features are further contemplated. For example, in many applications setting forth a paper-based container, the container wall may preferably comprise a stepped seam section at inner surfacing thereof indicative of the overlapping paper material. According to the present invention, the stepped seam section is preferably and structurally modified by removing material therefrom for providing flush surfacing at the radially outwardly extending indentation. This enhances the fit at the seam site.

The container lid may preferably comprise a lower lid construction and an upper lid construction, wherein the lower lid construction comprises upper concave surfacing, and the upper lid construction comprises lower convex surfacing. The upper lid construction is seatable atop the lower lid construction such that the lower convex surfacing and upper concave surfacing together form a spherical surface-to-surface seal and enable slidable open-close functionality. Preferably, the upper lid construction is resiliently actuable when seated atop the lower lid construction for enhancing seated engagement therebetween.

Noting that the container lid may preferably comprise a lower lid construction and an upper lid construction, the present invention further contemplates the inclusion of a flavor release patch or flavor patch element receivable intermediate the lower and upper lid constructions. The flavor release patch or flavor patch element basically functions to release flavor-enhancing particles when liquid is directed thereby before exiting a primary outlet formed in the upper lid construction.

An air pocket may be preferably defined in superior adjacency to an area of engagement between the radially outwardly extending indentation and the lid-locking bend or indentation-engaging portion when in the actuated configuration for enhancing a lid-to-container seal. The wall-to-groove-traversing resilient portion is preferably further configured to direct the lid-locking bend or indentation-engaging portion radially outwardly when lidded container contents are heated for further maximizing lid-to-container retention.

The wall-to-groove-traversing resilient portion may further preferably comprise a series of circumferentially spaced prong structures in certain embodiments. The series of circumferentially spaced prong structures are preferably receivable in the radially outwardly extending indentation when actuated into the actuated configuration for further maximizing lid-to-container retention. The radially outwardly extending indentation may further preferably comprise a series of circumferentially spaced prong-receiving cavities or pockets for receiving the series of circumferentially spaced prong structures when the wall-to-groove-traversing resilient portion is configured or directed into the actuated configuration for further maximizing lid-to-container retention.

Stated another way, the present invention may be said to most essentially teach or describe a lid-to-container locking combination for maximizing lid-to-container retention, which lid-to-container locking combination preferably and essentially comprises a container and a container lid. The container preferably comprises an upper container rim and a container wall, the container wall comprising an inner first matable formation exemplified by the radially outwardly extending indentation(s).

The container lid preferably comprises a resilient portion that is resiliently actuable intermediate a relaxed configuration and an actuated configuration and comprises an outer second matable formation exemplified by the radially outer indentation engaging portion. The outer second matable formation is matable with the inner first matable formation when the resilient portion is directed into the actuated configuration. The inner first and outer second matable formations thus cooperably function to lock the container lid to the container for maximizing lid-to-container retention.

Preferred optional features according to the present invention include a process of structurally modifying the stepped seam section of the container wall by removing material therefrom for providing flush surfacing at the inner first matable formation for enhancing maximized lid-to-container retention. Further, the container lid may preferably comprise a lower lid construction and an upper lid construction such that the lower lid construction comprises upper concave surfacing and the upper lid construction comprises lower convex surfacing. The upper lid construction is seatable atop the lower lid construction such that the lower convex surfacing and upper concave surfacing form a spherical surface-to-surface seal and enable slidable open-close functionality.

Noting that the container lid comprises a lower lid construction and an upper lid construction, it is further contemplated that the container lid (assembly) may comprise a flavor release patch receivable intermediate the lower and upper lid constructions. The flavor release patch basically functions to release flavor-enhancing particles when liquid is directed thereby before exiting a primary outlet formed in the upper lid construction.

BRIEF DESCRIPTIONS OF THE DRAWINGS

Other features and objectives of my invention will become more evident from a consideration of the following brief descriptions of patent drawings.

Figure 4:
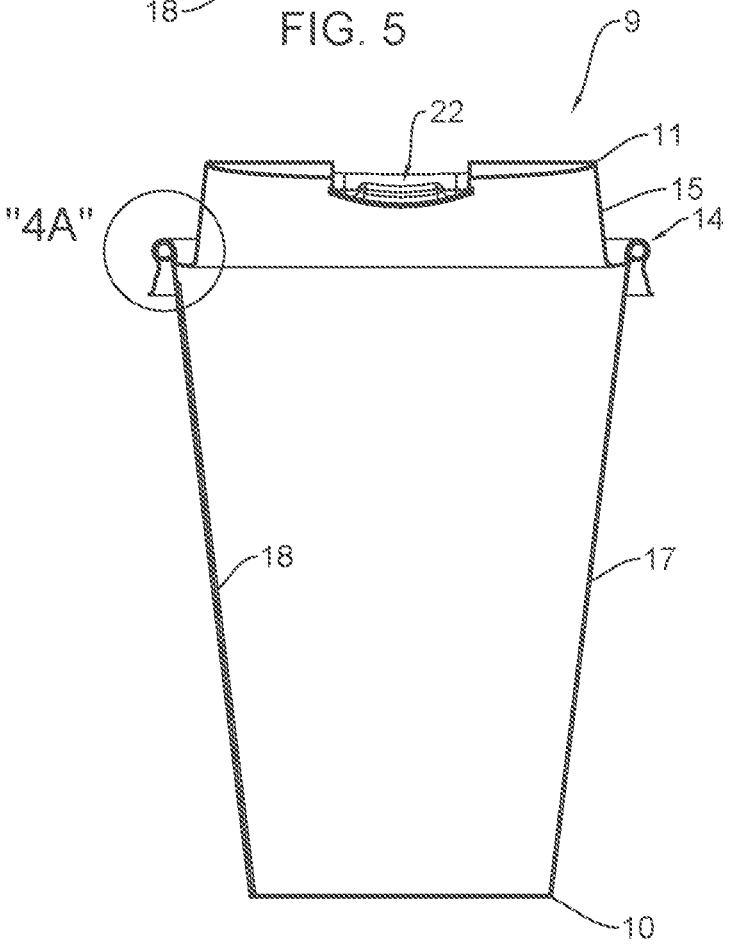
FIG. 4 is a frontal longitudinal cross-sectional view of the first alternative pressure-locking lid and seam-removed container combination according to the present invention depicting the combination in the assembled second or actuated state or configuration.
Figure 4A:
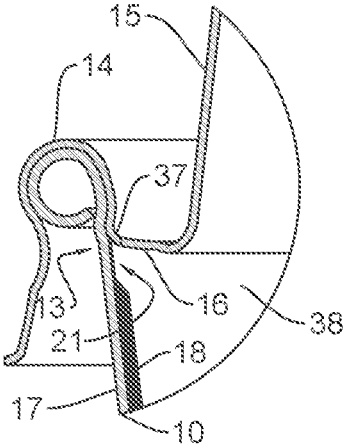

FIG. 4A is an enlarged, fragmentary sectional view of a container-to-lid junction site of the first alternative pressure-locking lid and seam-removed container combination according to the present invention as enlarged and sectioned from FIG. 4 to show in greater detail the structures associated with the container-to-lid junction site in superior adjacency to the seam junction where inner container material has been removed at the container seam.

Figure 5:
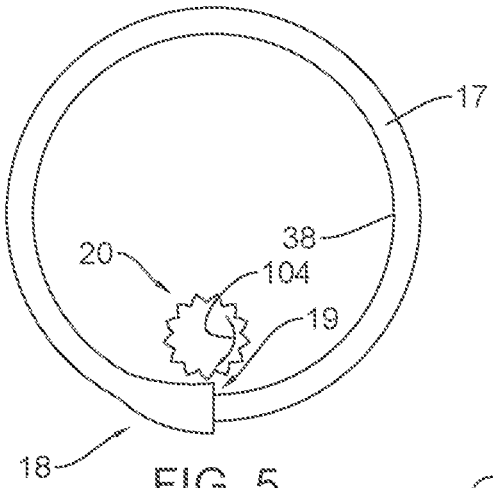

FIG. 5 is a diagrammatic depiction of a seamed container with a rotating implement just before the rotating implement is used to remove material from an inner container surface to render a smooth surface at an exaggerated seam site of the seamed container.

Figure 6:
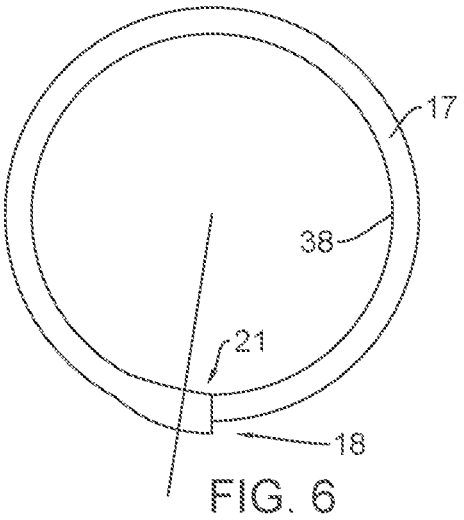

FIG. 6 is a diagrammatic depiction of a seamed container with a rotating implement just after the rotating implement has been used to remove material from an inner container surface to render a smooth surface at the exaggerated seam site of the seamed container.

Figure 7:
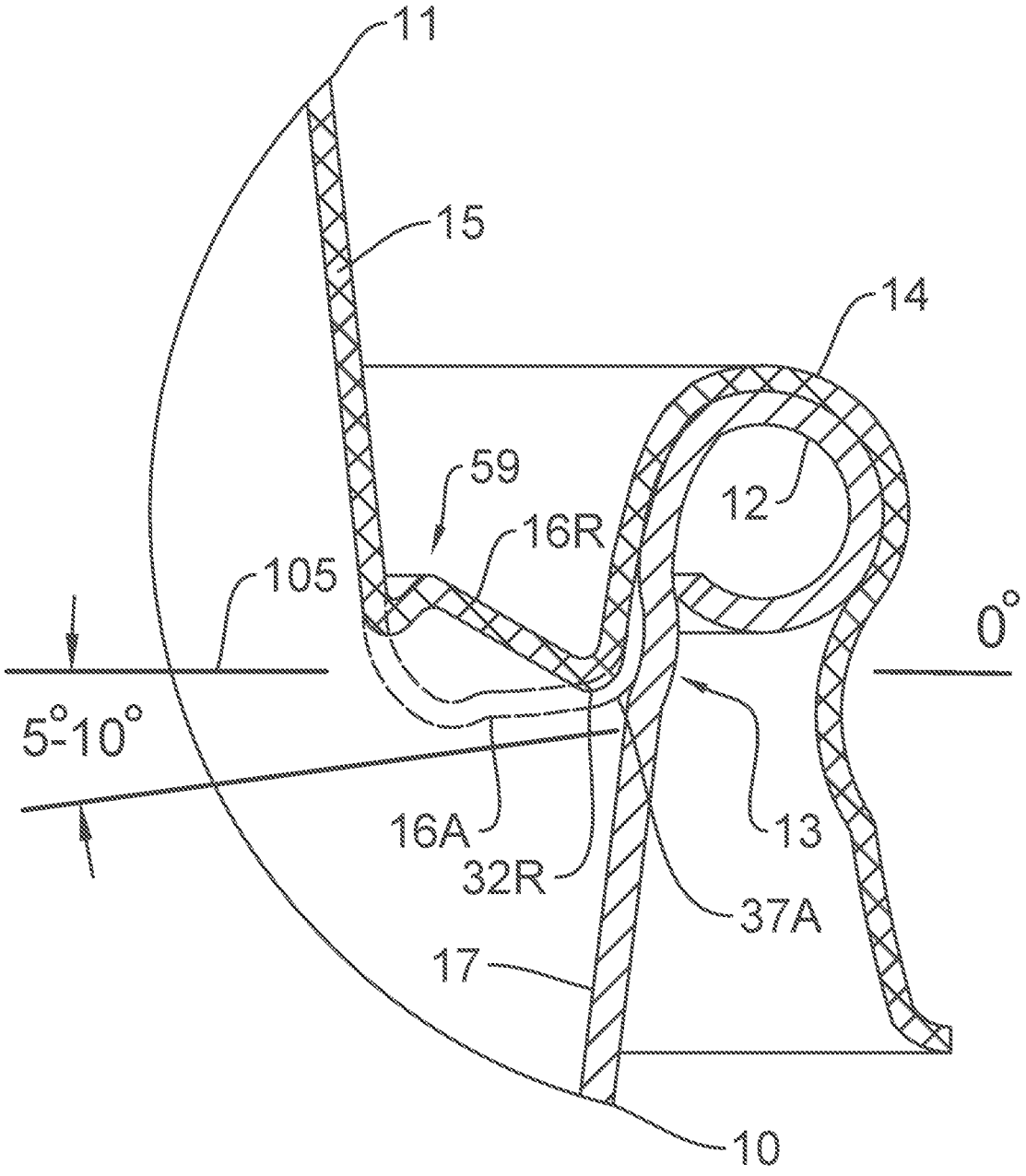

FIG. 7 is an enlarged, fragmentary sectional view of a container-to-lid junction site of the first alternative pressure-locking lid and seam-removed container combination according to the present invention as enlarged and sectioned to show in greater detail the structures associated with the container-to-lid junction site.

Figure 8:
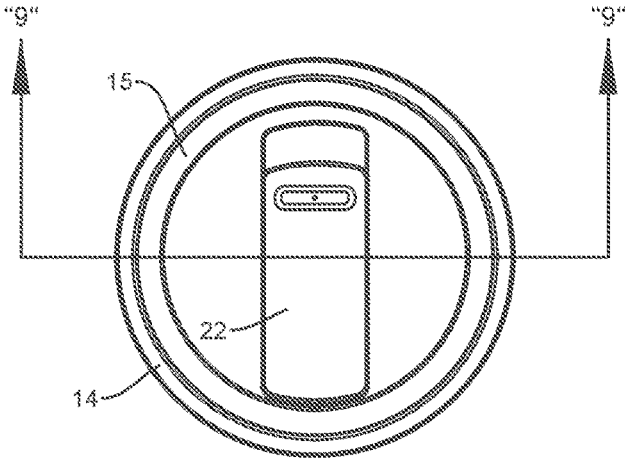

FIG. 8 is a top plan view of a first alternative lid construction according to the present invention showing a linearly displaceable slider element for opening and closing the first alternative lid construction.

Figure 9:
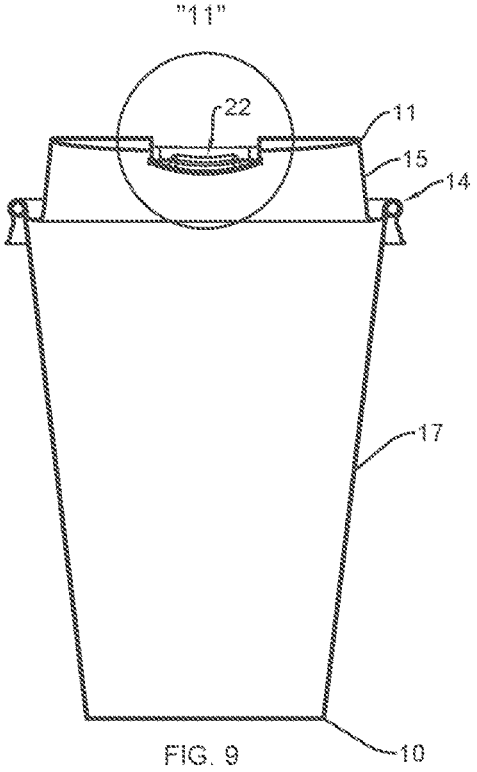

FIG. 9 is a frontal longitudinal cross-sectional view of the first alternative lid construction otherwise depicted in FIG. 8 as assembled with a first alternative container construction.

Figure 10:
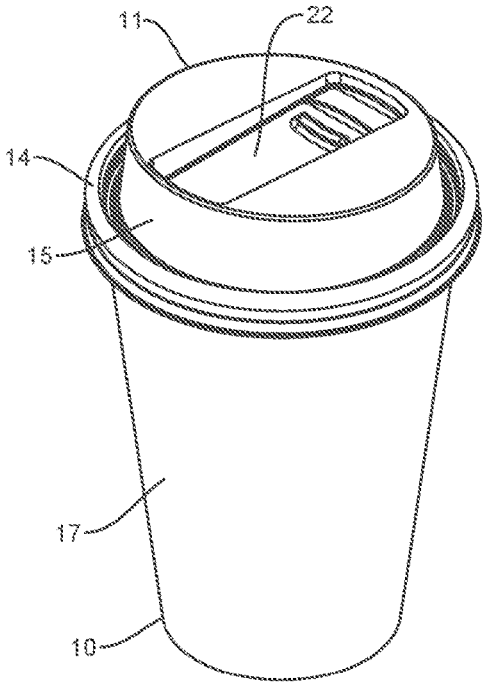

FIG. 10 is a top perspective view of the first lid construction according to the present invention in assembled relation with a container construction and depicting the linearly displaceable slider element or first alternative upper lid construction for opening and closing the first alternative lid construction.

Figure 11:
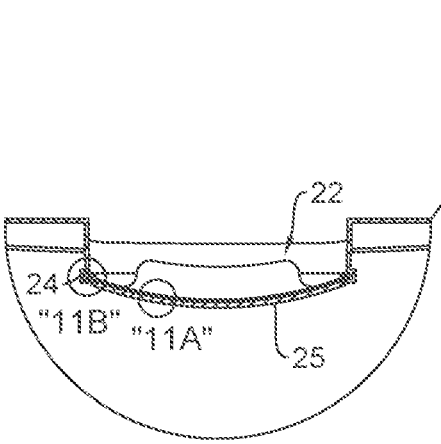

FIG. 11 is an enlarged fragmentary sectional view as sectioned from FIG. 10 to show in greater detail the slider element or first alternative upper lid construction received in a laterally aligned groove formed in the first alternative lower lid construction.

Figure 11B:
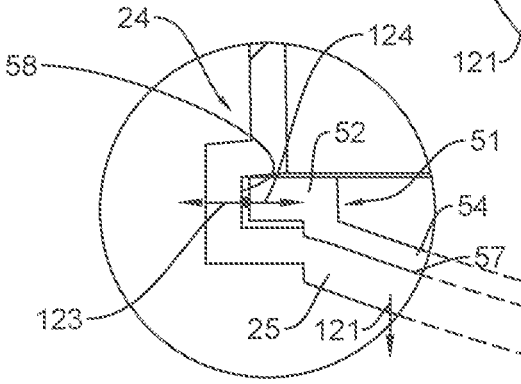
Figure 11A:
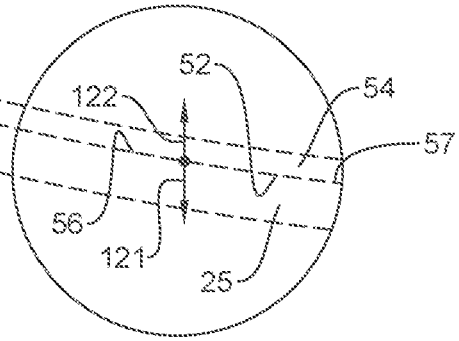

FIG. 11A is a fragmentary, enlarged sectional view as enlarged and sectioned from FIG. 11 to show in greater detail the slider element to insert-receiving formation interface otherwise there depicted.

FIG. 11B is a fragmentary, enlarged sectional view as enlarged and sectioned from FIG. 11 to show in greater detail a step-down formation of the slider element in engagement with the edge-receiving groove of the first alternative lower lid construction.

Figure 12:
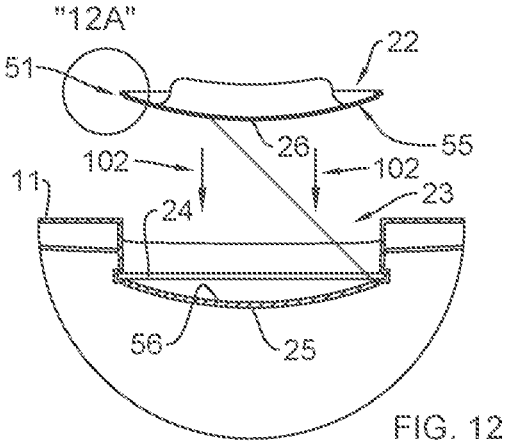

FIG. 12 is an enlarged fragmentary sectional and exploded view to show in greater detail the slider element first alternative upper lid construction exploded from the laterally aligned groove formed in the first alternative lower lid construction.

Figure 12A:
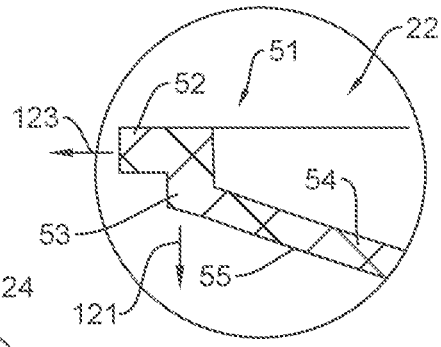

FIG. 12A is a fragmentary, enlarged sectional view as enlarged and sectioned from FIG. 12 to show in greater detail a step-down formation of the slider element otherwise there depicted.

Figure 13:
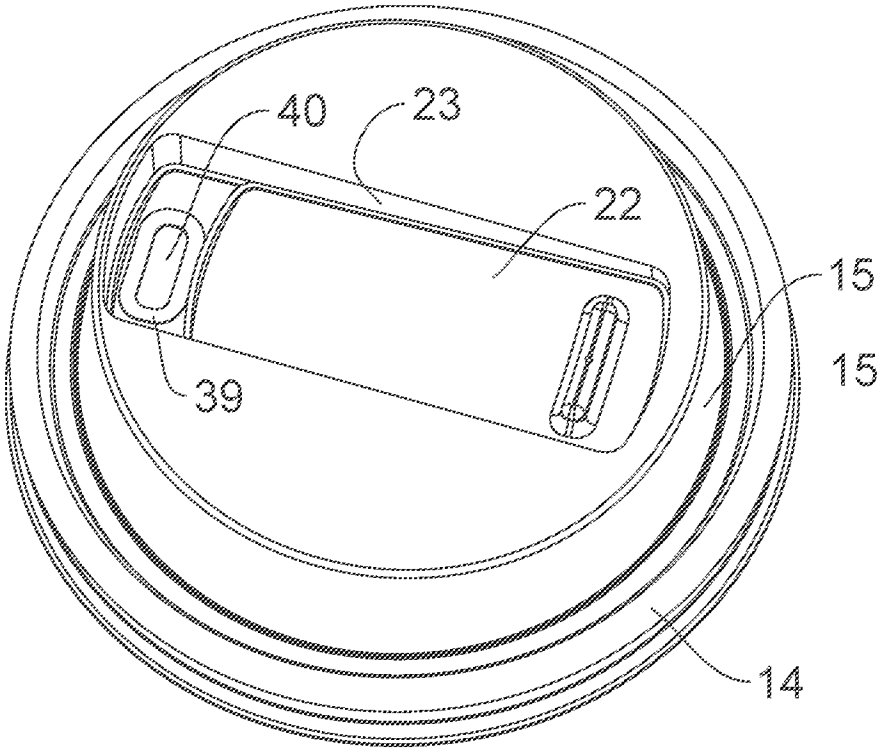

FIG. 13 is a top perspective view of the first alternative lid construction according to the present invention depicting the linearly displaceable slider element or first alternative upper lid construction linearly displaced to an open state or configuration.

Figure 14:
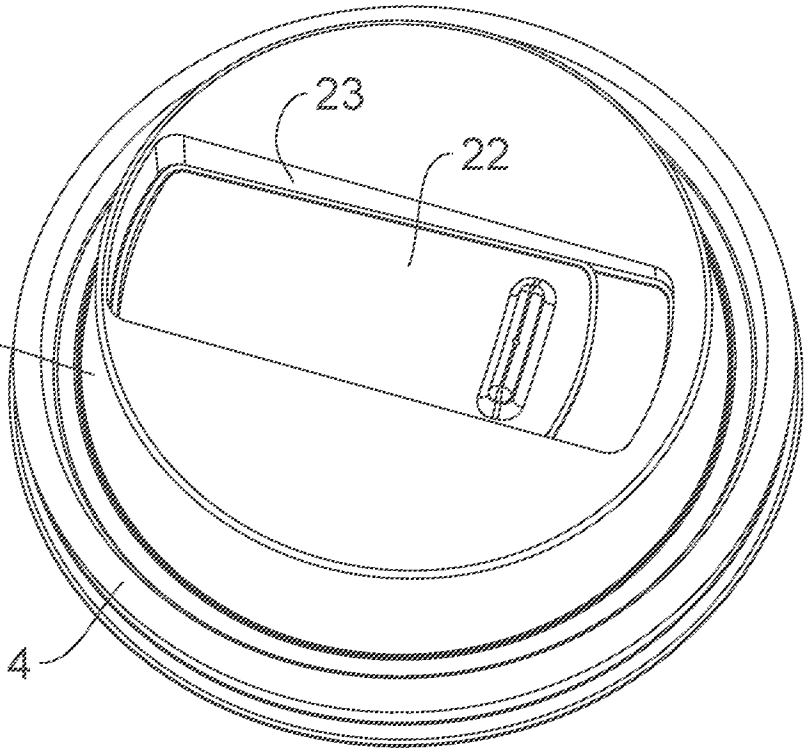

FIG. 14 is a top perspective view of the first alternative lid construction according to the present invention depicting the linearly displaceable slider element first alternative upper lid construction linearly displaced to a closed state or configuration.

Figure 15A:
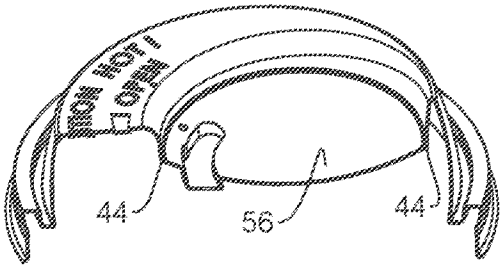
Figure 15:
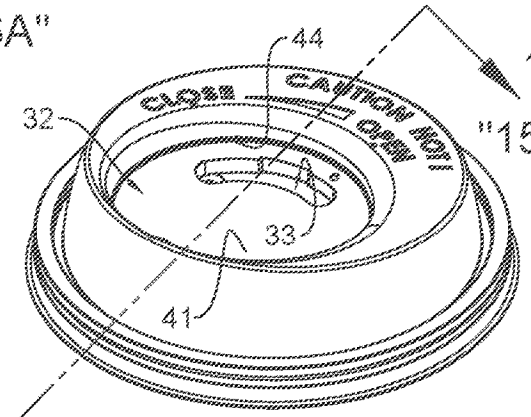

FIG. 15 is a top perspective view of a second alternative lower lid construction according to the present invention showing an upper insert-receiving cavity having a nub-receiving arc-length groove formed therein, the second alternative lower lid construction being depicted with a second alternative upper insert removed therefrom.

FIG. 15A is a longitudinal cross-sectional view as sectioned from FIG. 15 to show cross-sectional details of the second alternative lower lid construction according to the present invention.

Figure 16B:
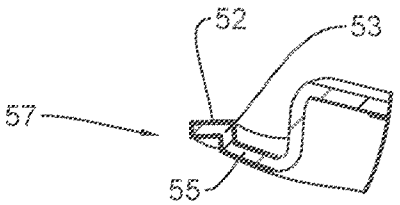
Figure 16A:
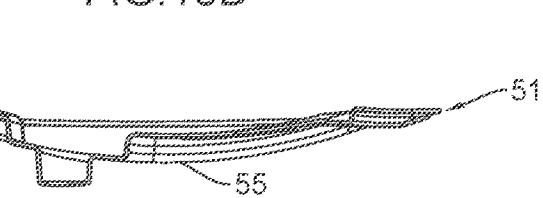
Figure 16:
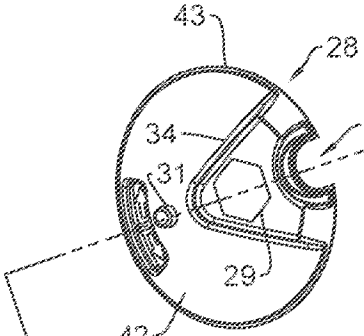

FIG. 16 is a bottom perspective view of the second alternative upper insert construction according to the present invention as removed from the second alternative lower lid construction as otherwise depicted in FIG. 15 and outfitted with a groove-engaging nub and an optional flavor release patch as received or outfitted within a raised triangular formation of the second alternative upper insert construction.

FIG. 16A is an enlarged, longitudinal cross-sectional view as enlarged and sectioned from FIG. 16 to show greater cross-sectional details of the second alternative upper insert construction according to the present invention.

FIG. 16B is a fragmentary, enlarged sectional view as enlarged and sectioned from FIG. 16A to show still greater detail of the step-down formation of the second alternative upper insert construction according to the present invention.

Figure 17:
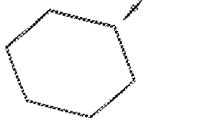

FIG. 17 is an enlarged bottom perspective view of the optional flavor release patch as removed from the second alternative upper insert construction otherwise depicted in FIG. 16.

Figure 18:
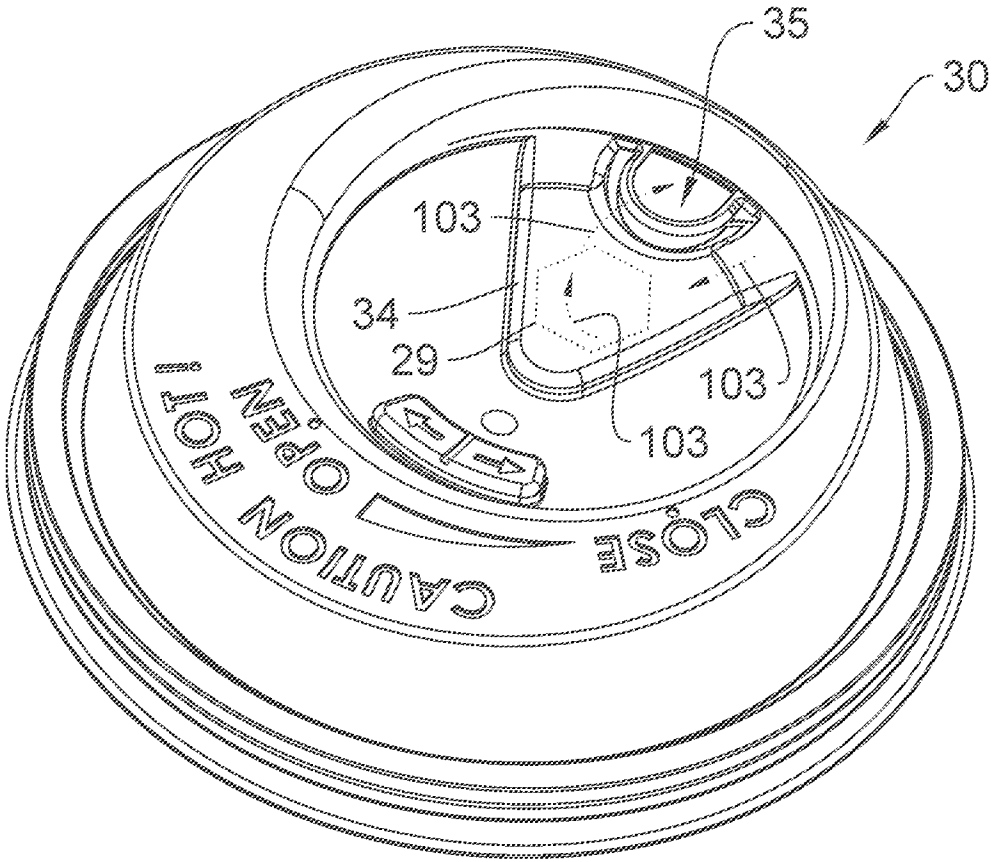

FIG. 18 is a top perspective view of the second alternative lid construction according to the present invention showing the second alternative upper insert construction received in the insert-receiving cavity and depicting the hidden optional flavor release patch in broken lining to show relative position of the optional flavor release patch relative to the primary beverage outlet of the second alternative lid construction and directional arrows depicting liquid path to the primary beverage outlet via the optional flavor release patch.

Figure 19:
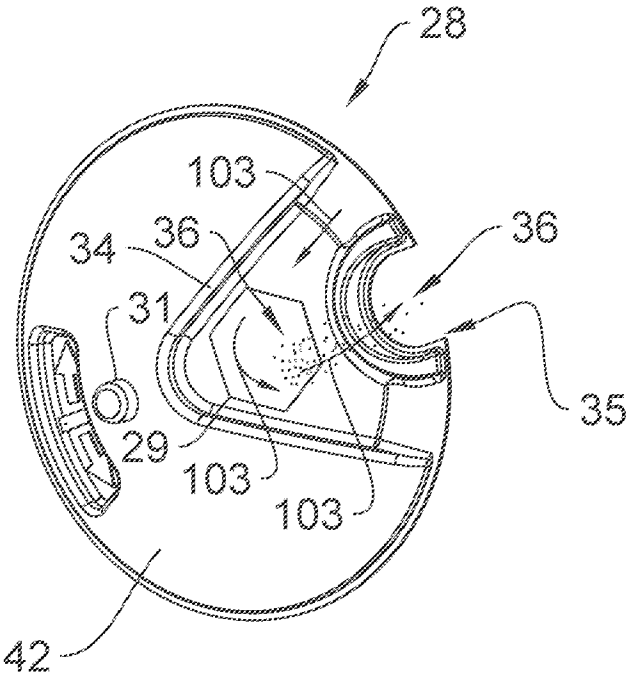

FIG. 19 is a bottom perspective view of the second alternative upper insert construction depicting the optional flavor release patch in solid lining to show relative position of the optional flavor release patch relative to the primary beverage outlet of the second alternative lid construction and directional arrows depicting liquid path to the primary beverage outlet via the optional flavor release patch.

Figure 20A:
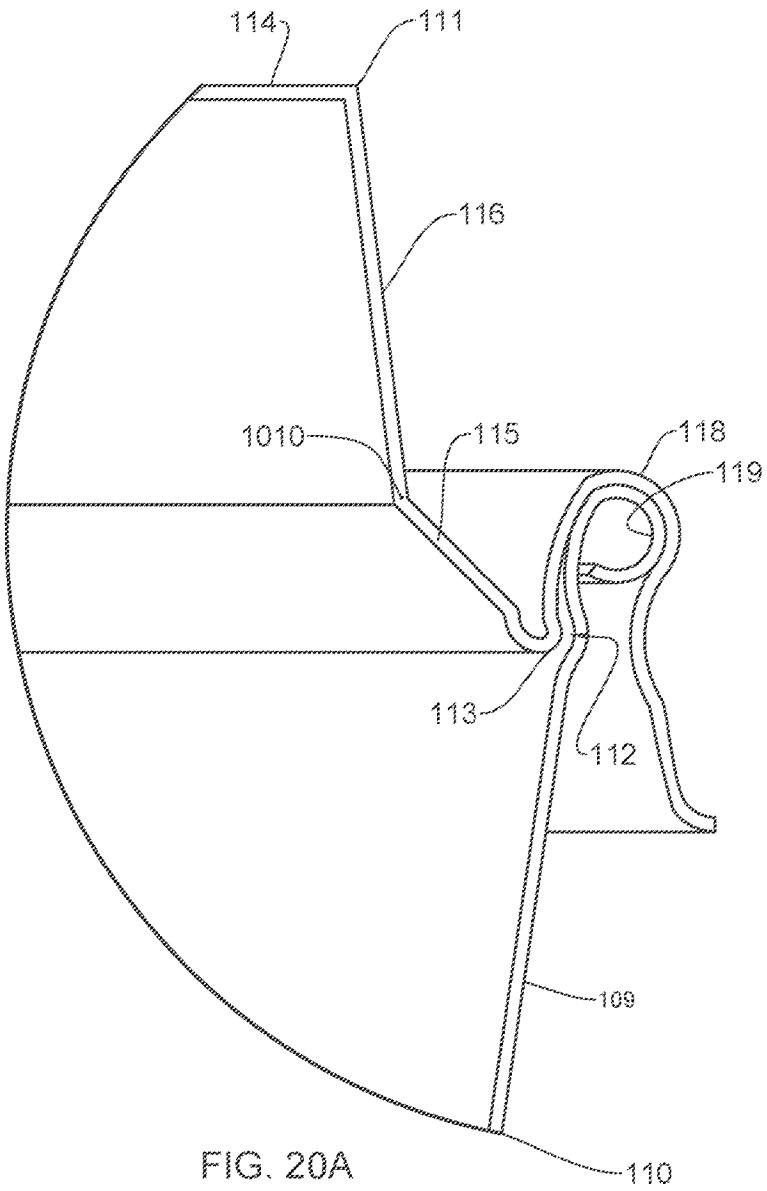
Figure 20:
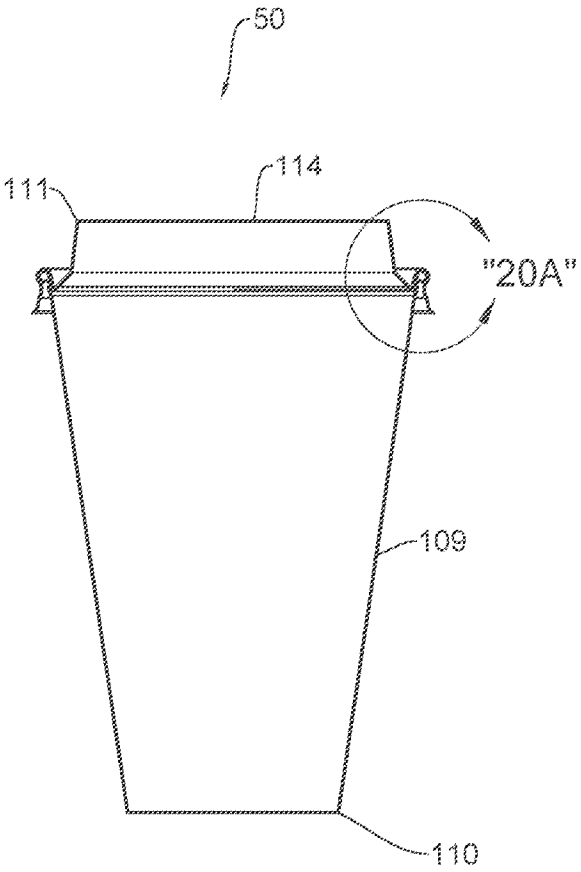

FIG. 20 is a first sequential longitudinal cross-sectional view of a second alternative pressure-locking lid construction and container combination according to the present invention.

Figure 1:
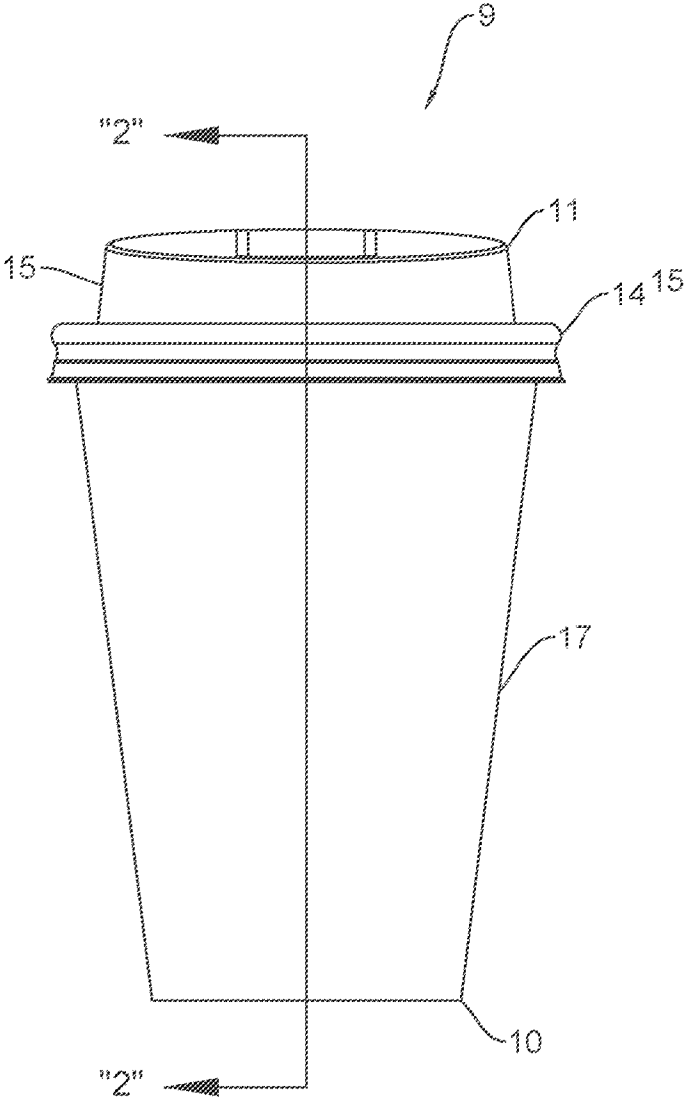
FIG. 1 is a posterior elevational view of a first alternative pressure-locking lid and seam-removed container combination according to the present invention.

FIG. 20A is a first enlarged fragmentary sectional view of the second alternative pressure-locking lid construction and container combination according to the present invention as sectioned from FIG. 1 to show in greater detail structures associated with the junction site between a third alternative pressure-locking lid construction and a second alternative container before the third alternative pressure-locking lid construction is pressure-locked thereto.

Figure 21A:
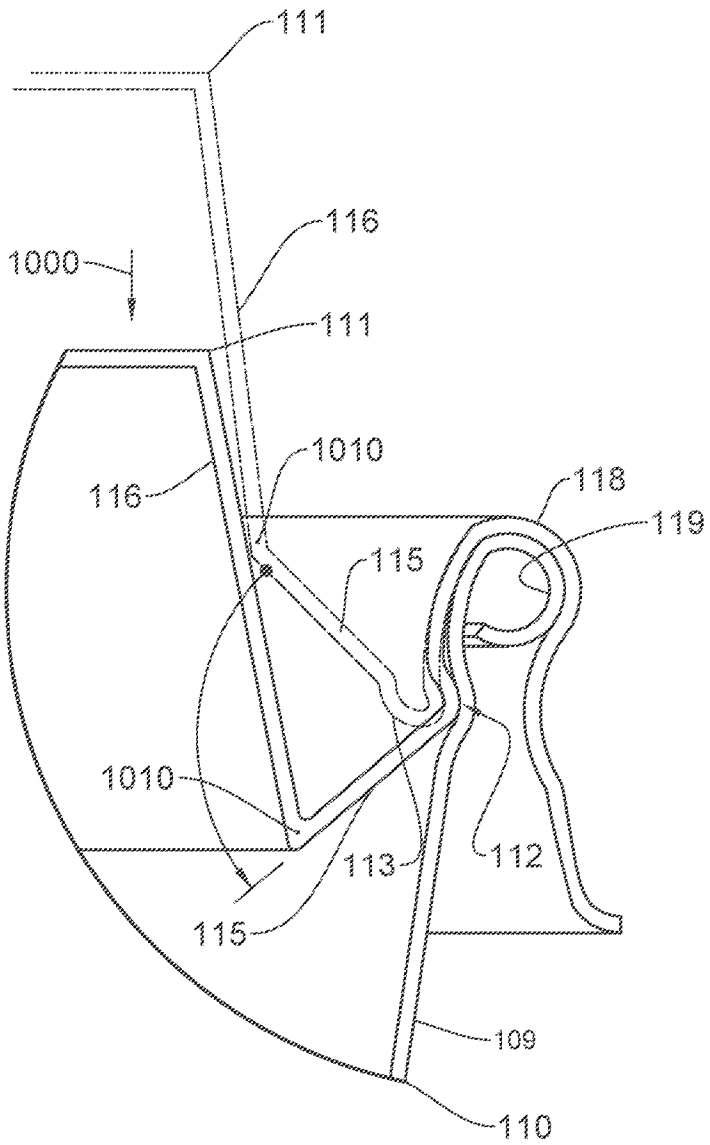
Figure 21:
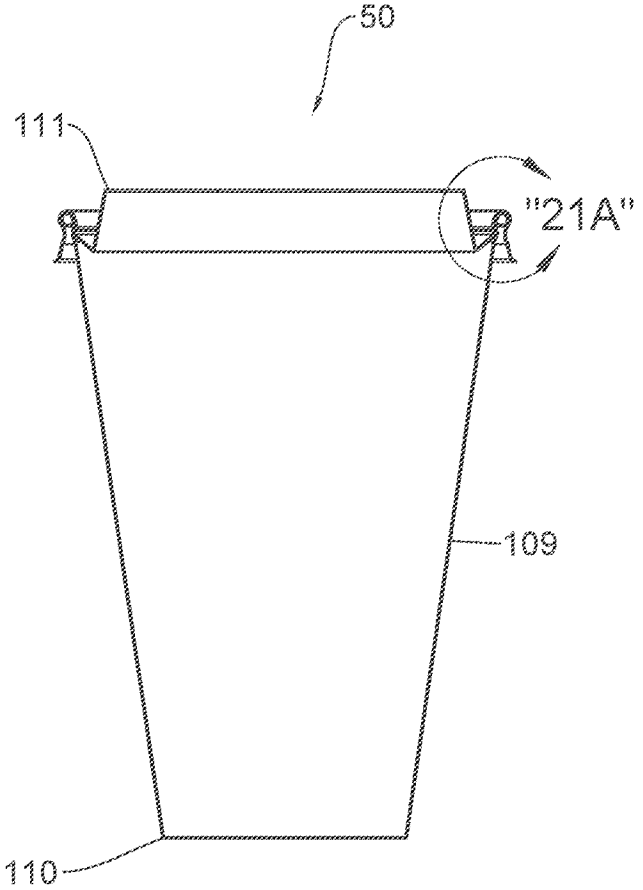

FIG. 21 is a second sequential longitudinal cross-sectional view of the second alternative pressure-locking lid construction and container combination according to the present invention.

FIG. 21A is a first enlarged fragmentary sectional view of the second alternative pressure-locking lid construction and container combination according to the present invention as sectioned from FIG. 21 to show in greater detail structures associated with the junction site between the third alternative pressure-locking lid construction and the second alternative container as the lid construction is pressure-locked into engagement with the lower container.

Figure 22A:
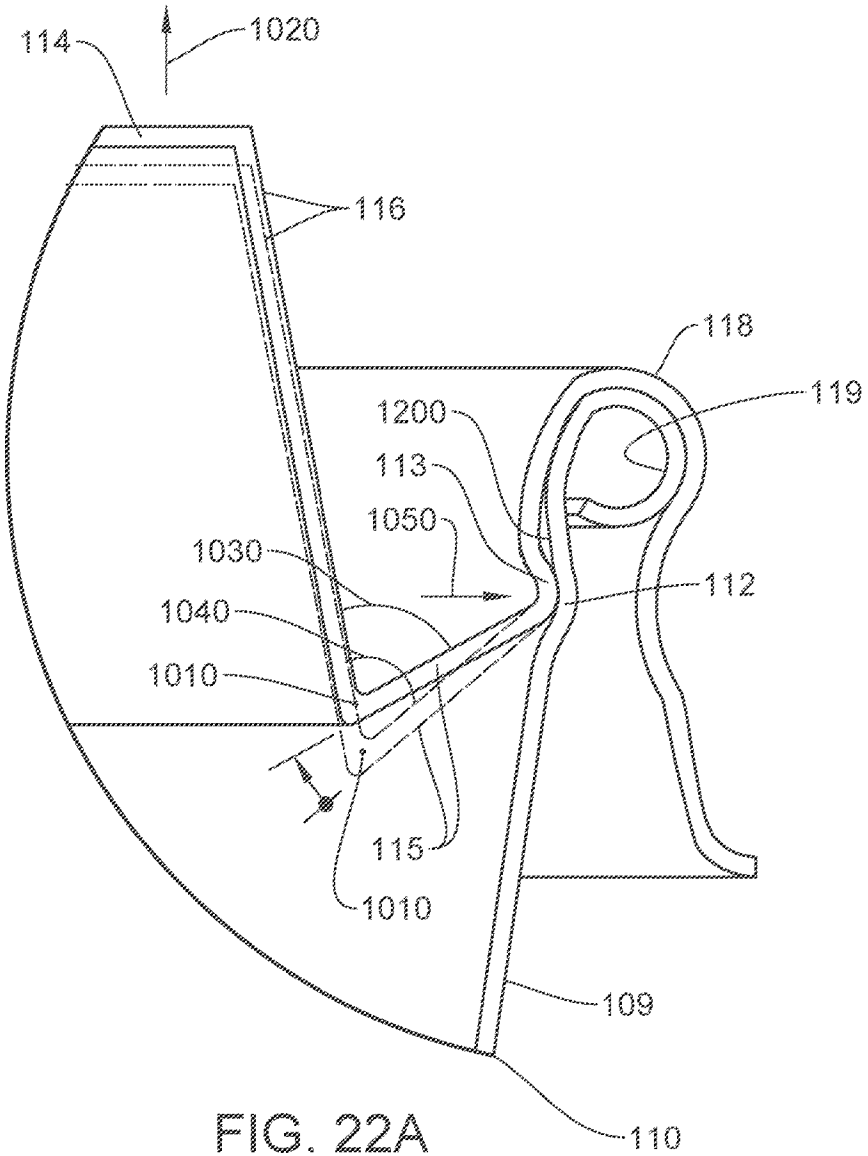
Figure 22:
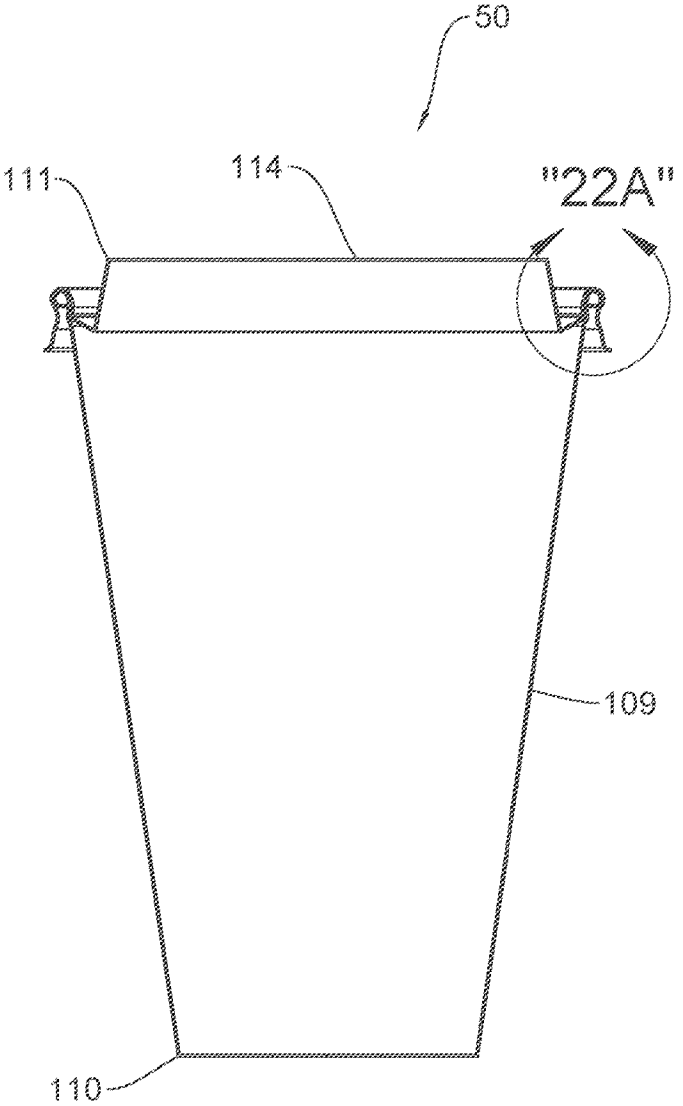

FIG. 22 is a third sequential longitudinal cross-sectional view of the second alternative pressure-locking lid construction and container combination according to the present invention.

FIG. 22A is a first enlarged fragmentary sectional view of the second alternative pressure-locking lid construction and container combination according to the present invention as sectioned from FIG. 22 to show in greater detail structures associated with the junction site between the third alternative pressure-locking lid construction and the second alternative container as the lid construction resiliently returns to a static configuration with the container.

Figures 23, 24, 25:
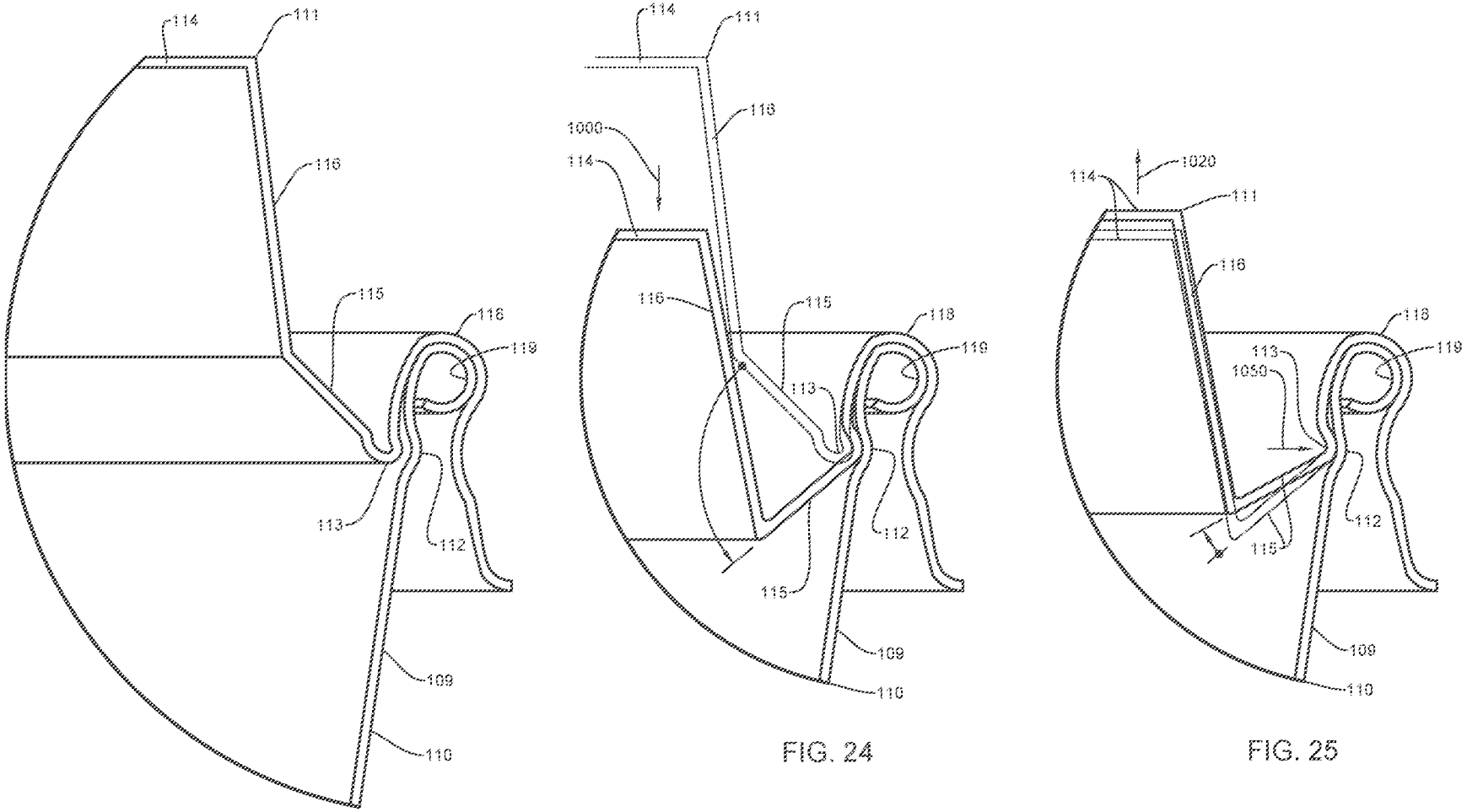

FIG. 23 is a second fragmentary sectional view of the second alternative pres sure-locking lid construction and container combination according to the present invention as re-presented from FIG. 20A for side-by-side comparison purposes with FIGS. 24 and 25.

FIG. 24 is a second fragmentary sectional view of the second alternative pressure-locking lid construction and container combination according to the present invention as re-presented from FIG. 21A for side-by-side comparison purposes with FIGS. 23 and 25.

FIG. 25 is a second fragmentary sectional view of the second alternative pres sure-locking lid construction and container combination according to the present invention as re-presented from FIG. 22A for side-by-side comparison purposes with FIGS. 23 and 24.

Figure 26:
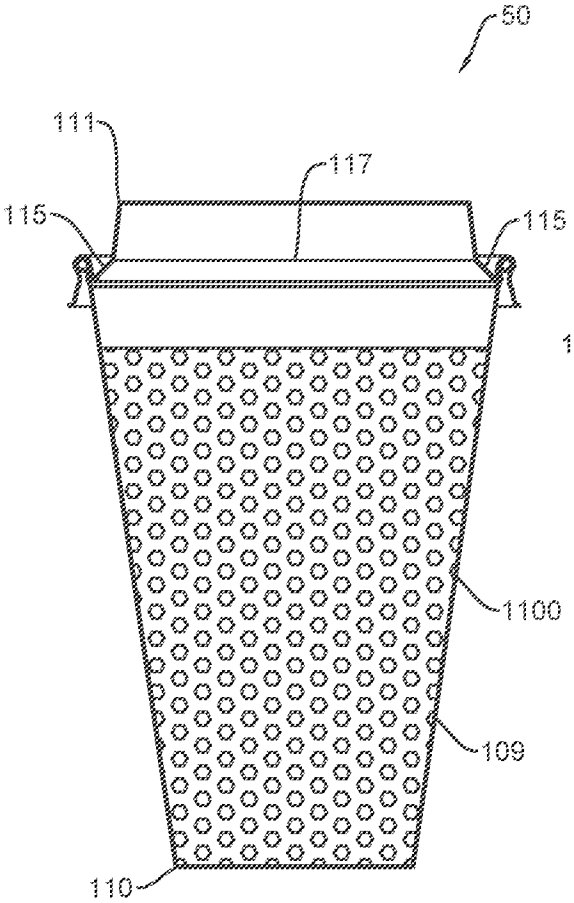

FIG. 26 is a first sequential diagrammatic depiction of the second alternative pressure-locking lid construction and container combination according to the present invention depicting internal contents under equalized pressure relative to the external atmosphere and depicting the third alternative lid construction is a first actuated state or configuration.

Figure 27:
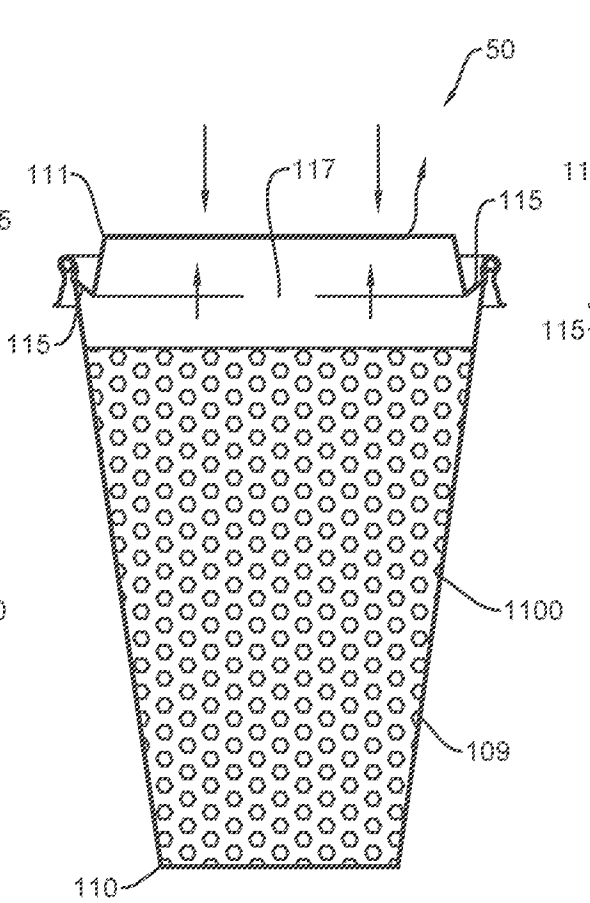

FIG. 27 is a second sequential diagrammatic depiction of the second alternative pressure-locking lid construction and container combination according to the present invention depicting internal contents under increasing pressure relative to the external atmosphere and depicting the third alternative lid construction beginning to reconfigure into a second actuated state or configuration.

Figure 28:
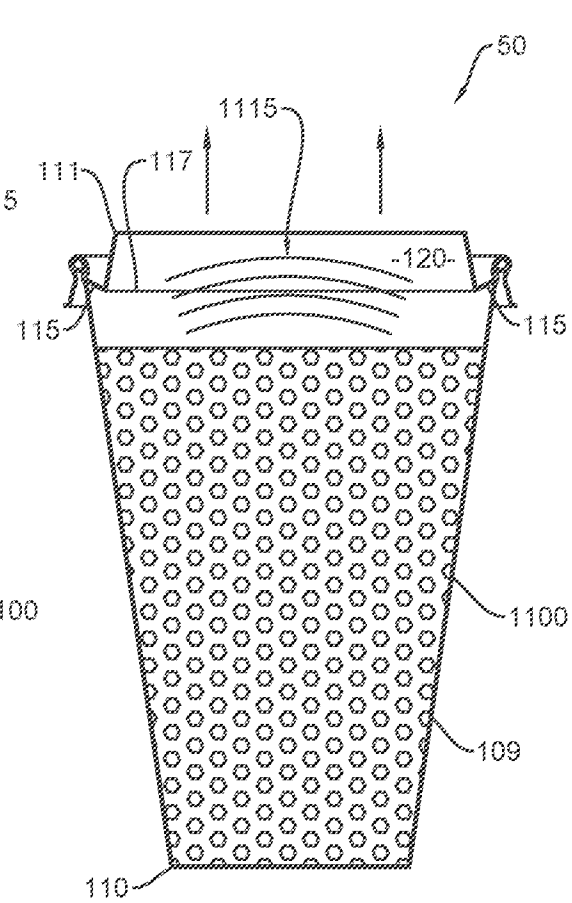

FIG. 28 is a third sequential diagrammatic depiction of the second alternative pressure-locking lid construction and container combination according to the present invention depicting internal contents under increased pressure relative to the external atmosphere and depicting the third alternative lid construction in a second actuated state or configuration.

Figure 29:
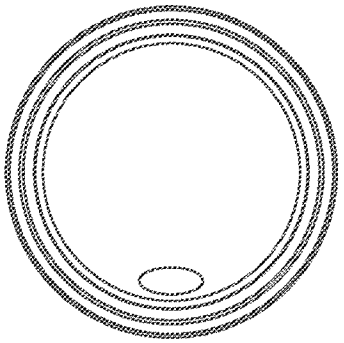

FIG. 29 is a top plan view of a second iteration of the second alternative pressure-locking lid construction and container combination according to the present invention with slight structural changes relative to the first iteration of the second alternative pressure-locking lid construction and container combination.

Figure 30:
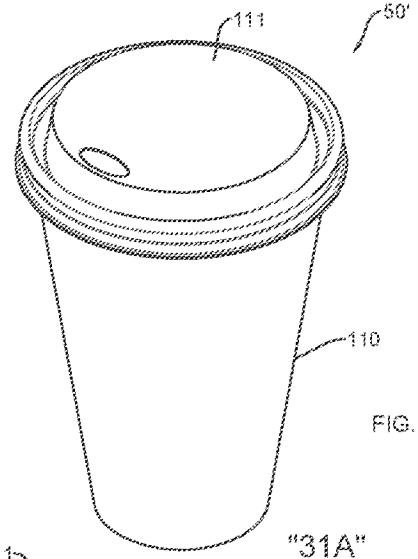

FIG. 30 is a top perspective view of the second iteration of the second alternative pressure-locking lid construction and container combination according to the present invention with slight structural changes relative to the first iteration of the second alternative pressure-locking lid construction and container combination.

Figure 31:
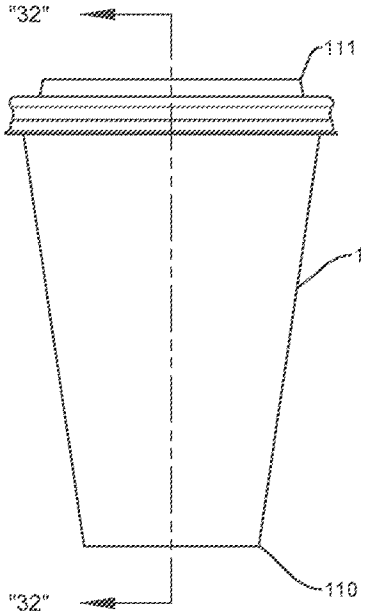

FIG. 31 is a side elevational view of the second iteration of the second alternative pressure-locking lid construction and container combination according to the present invention with slight structural changes relative to the first iteration of the second alternative pressure-locking lid construction and container combination.

Figure 32:
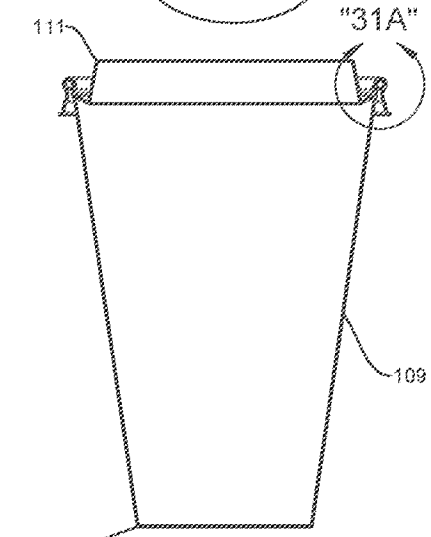

FIG. 32 is a longitudinal cross-sectional view of the second iteration of the second alternative pressure-locking lid construction and container combination according to the present invention as sectioned from FIG. 31.

Figure 32A:
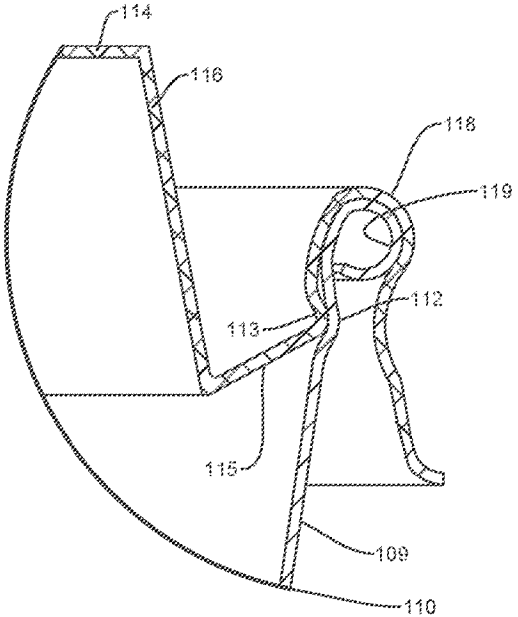

FIG. 32A is a fragmentary enlarged sectional view of the second iteration of the second alternative pressure-locking lid construction and container combination according to the present invention as sectioned from FIG. 32 to show in greater detail structural features of the lid to container junction site of the second iteration of the third alternative lid construction as attached to the second alternative container.

Figure 33:
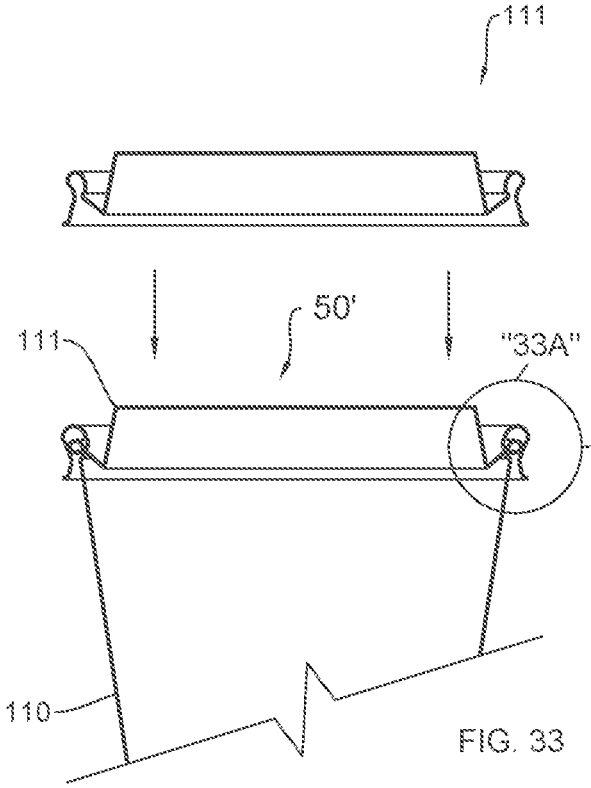

FIG. 33 is a fragmentary longitudinal sectional view of the second iteration of the of the second alternative pressure-locking lid construction and container combination according to the present invention showing an upper third alternative pressure-locking lid construction exploded from the second iteration of the of the second alternative pressure-locking lid construction and container combination with the upper and the lower third alternative pres sure-locking lid constructions in a pre-engaged state or configuration.

Figure 33A:
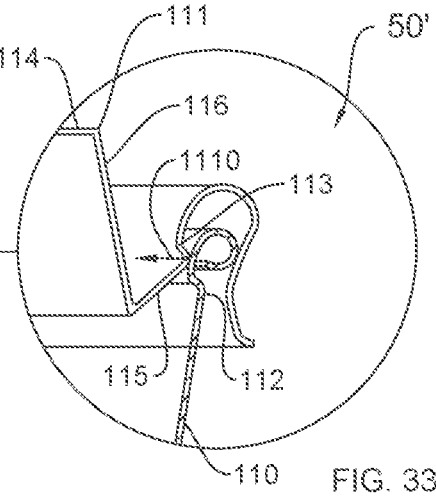

FIG. 33A is a first enlarged fragmentary sectional view of the second alternative pressure-locking lid construction and container combination as sectioned from FIG. 33 to show in greater detail directional force directed into the locking ridge structure as the third alternative pressure-locking lid construction engages the second alternative container.

Figure 34:
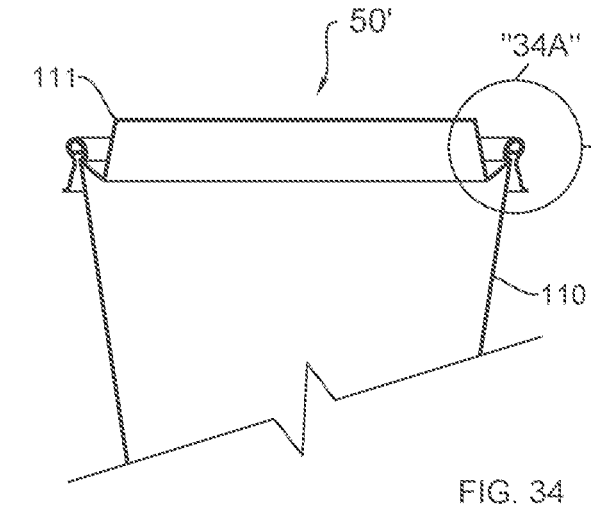

FIG. 34 is a fragmentary longitudinal sectional view of the second iteration of the of the second alternative pressure-locking lid construction and container combination according to the present invention with the third alternative pressure-locking lid construction in an engaged, static configuration.

Figure 34A:
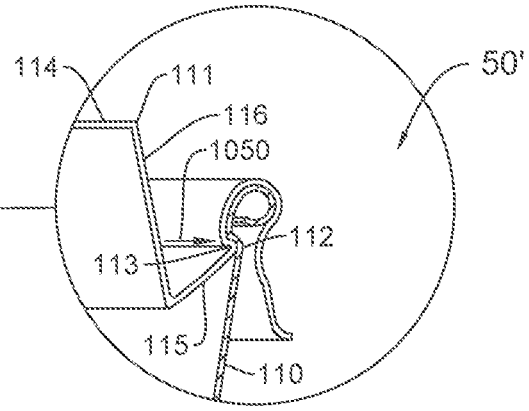

FIG. 34A is a first enlarged fragmentary section view of the second iteration of the of the second alternative pressure-locking lid construction and container combination as sectioned from FIG. 34 to show in greater detail directional force directed into the locking groove when in the static configuration.

Figure 35:
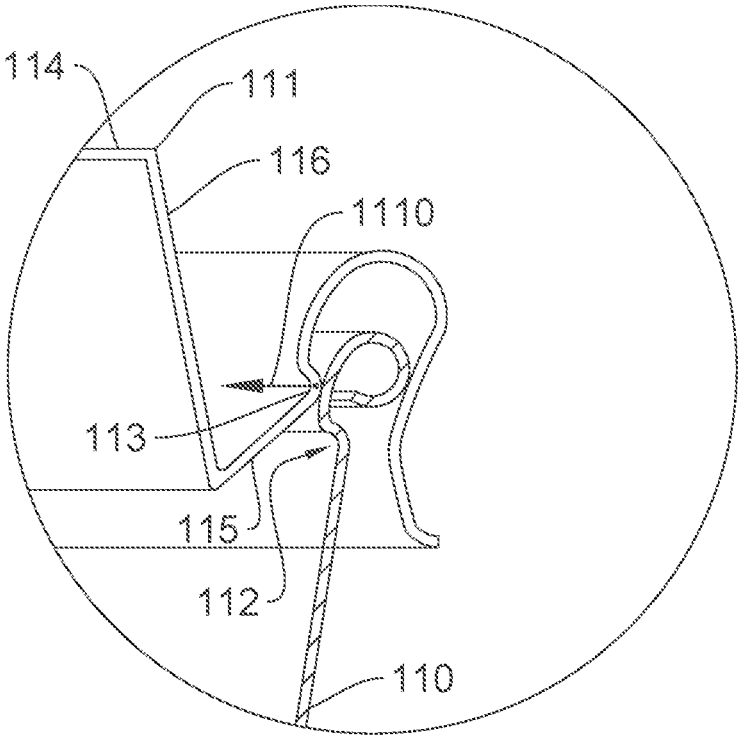

FIG. 35 is a second enlarged fragmentary section view of the second alternative pressure-locking lid construction and container combination as enlarged from FIG. 33A to show in still greater detail directional force directed into the relaxed/un-deformed locking ridge structure as the as the third alternative pressure-locking lid construction engages the second alternative container.

Figure 36:
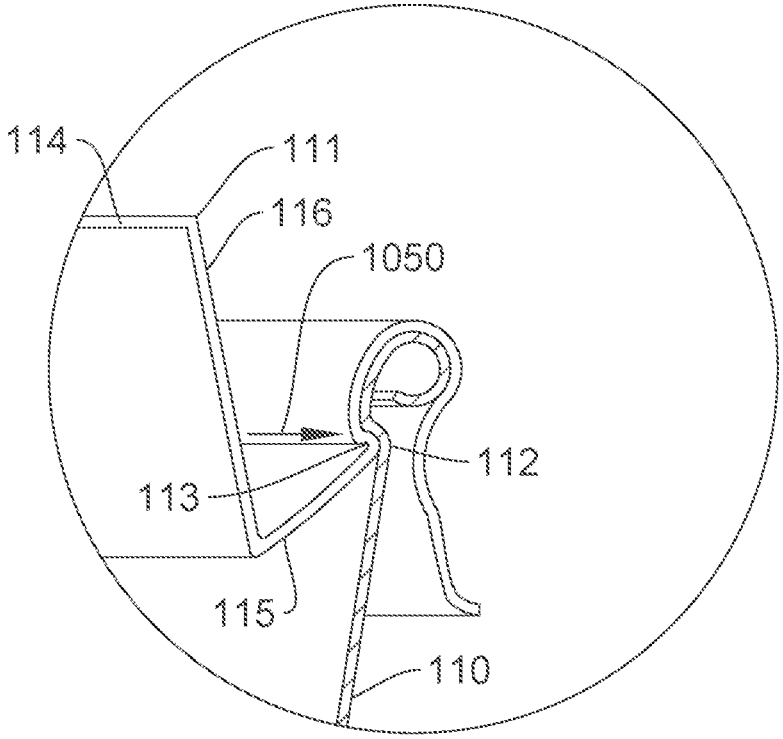

FIG. 36 is a second enlarged fragmentary section view of the second alternative pressure-locking lid construction and container combination as enlarged from FIG. 34A to show in still greater detail directional force directed into the locking groove via the actuated/deformed locking ridge structure 13 when in the static configuration.

FIG. 37 is a top plan view of a fourth alternative pressure-locking lid construction according to the present invention showing a series of equally spaced, peripherally or circumferentially arranged prong structures.

FIG. 38 is a top perspective view of the fourth alternative pressure-locking lid construction according to the present invention showing a series of equally-spaced, peripherally or circumferentially arranged prong structures.

FIG. 39 is a cross-sectional view of the fourth alternative pressure-locking lid construction according to the present invention as sectioned from FIG. 37 adjacent to prong structures for the purpose of highlighting structural formations therethrough.

FIG. 39A is a fragmentary enlarged sectional view as sectioned from FIG. 39 to show in greater detail the structural formations adjacent a select prong structure.

FIG. 40 is a cross-sectional view of the fourth alternative pressure-locking lid construction according to the present invention as sectioned from FIG. 37 through prong structures for the purpose of highlighting structural formations therethrough.

FIG. 40A is a fragmentary enlarged sectional view as sectioned from FIG. 40 to show in greater detail the structural formations at a select prong structure.

Figure 41:
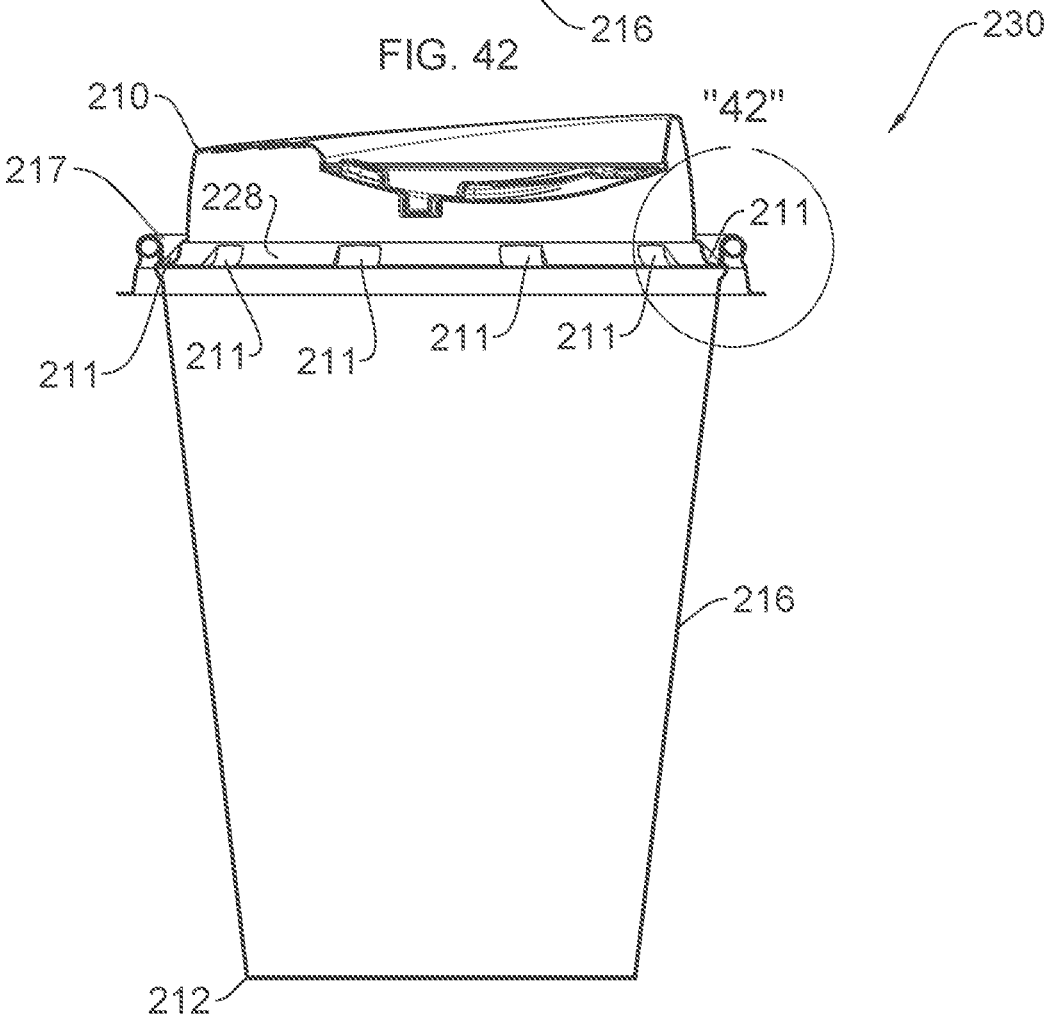

FIG. 41 is a longitudinal cross-sectional view of a third alternative pressure-locking lid construction and container combination according to the present invention, the longitudinal cross-section being through select prong structures of the fourth alternative pressure-locking lid construction when in a prong-relaxed engaged configuration.

Figure 42:
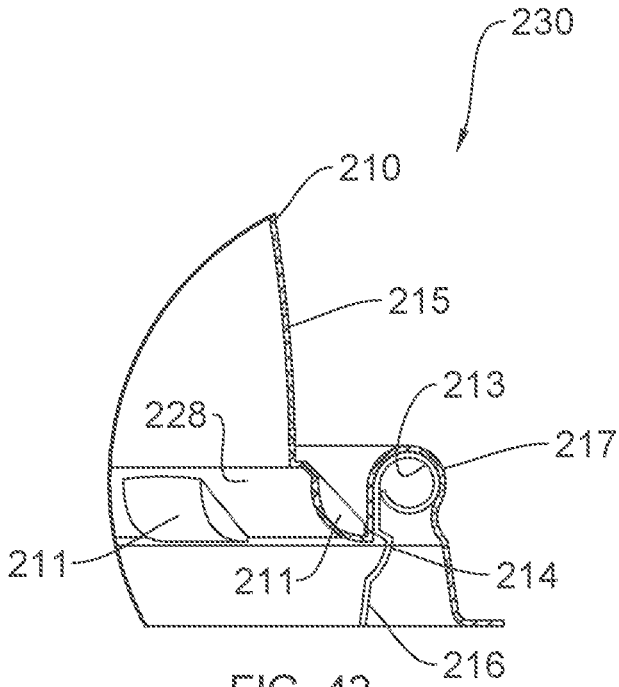

FIG. 42 is a fragmentary enlarged sectional view as sectioned from FIG. 41 to show in greater detail the structural formations at the junction site between a select prong structure and an upper container rim of the third alternative container when in the prong-relaxed engaged configuration.

Figure 43:
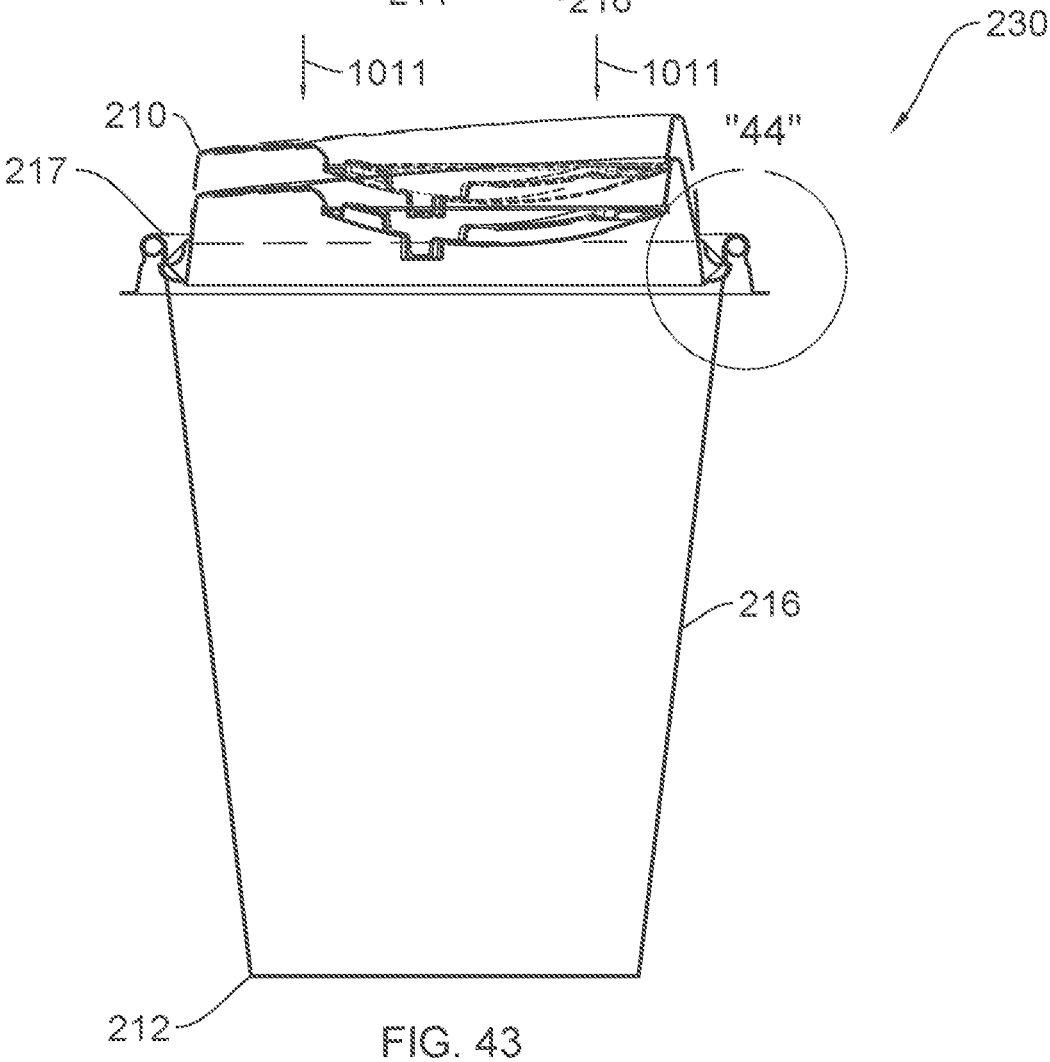

FIG. 43 is a longitudinal cross-sectional view of the third alternative pressure-locking lid construction and container combination according to the present invention, the longitudinal cross-section being through select prong structures of the fourth alternative pressure-locking lid construction when in a prong-actuated engaged configuration.

Figure 44:
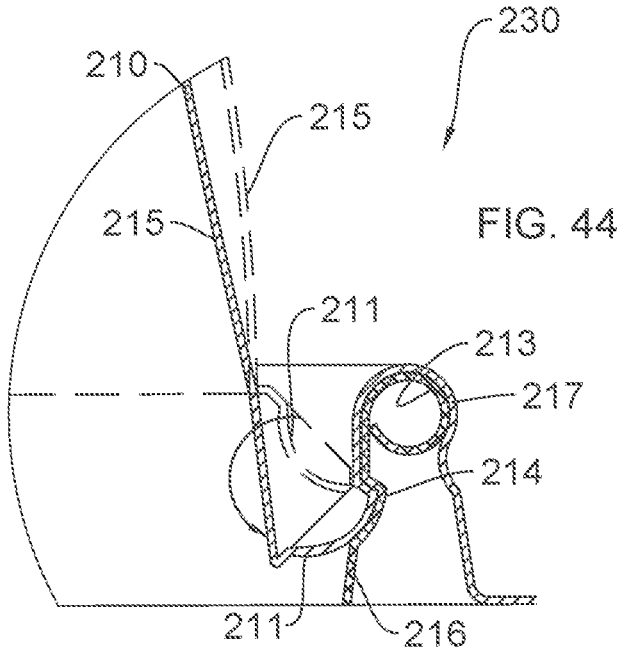

FIG. 44 is a fragmentary enlarged sectional view as sectioned from FIG. 43 to show in greater detail the structural formations at the junction site between a select prong structure and an upper container rim of the third alternative container when in the prong-actuated engaged configuration.

Figure 45:
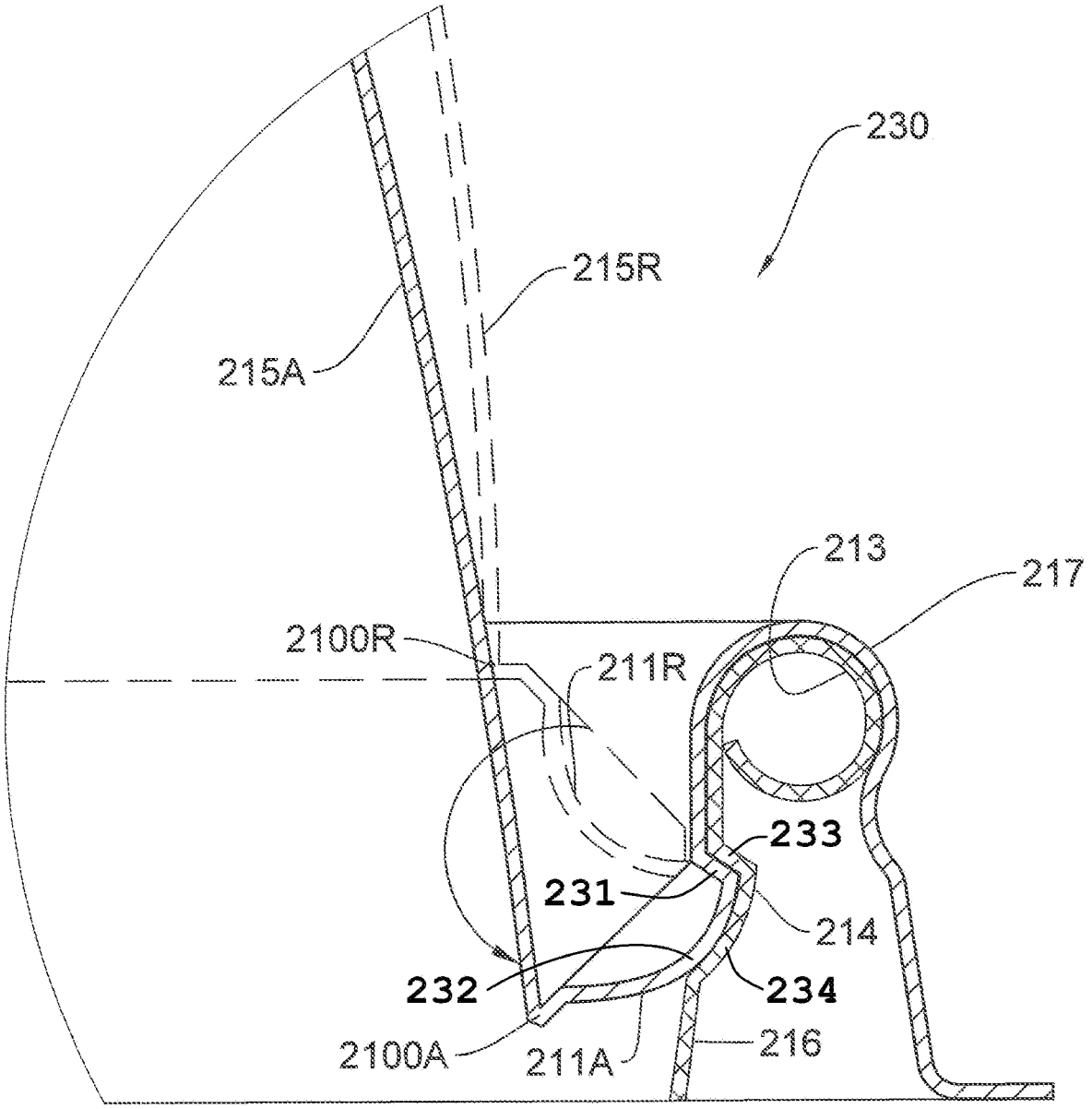

FIG. 45 is a fragmentary further enlarged sectional view as further enlarged from FIG. 44 to show in still greater detail the structural formations at the junction site between a select prong structure and an upper container rim of the third alternative container when in the prong-actuated engaged configuration.

Figure 46:
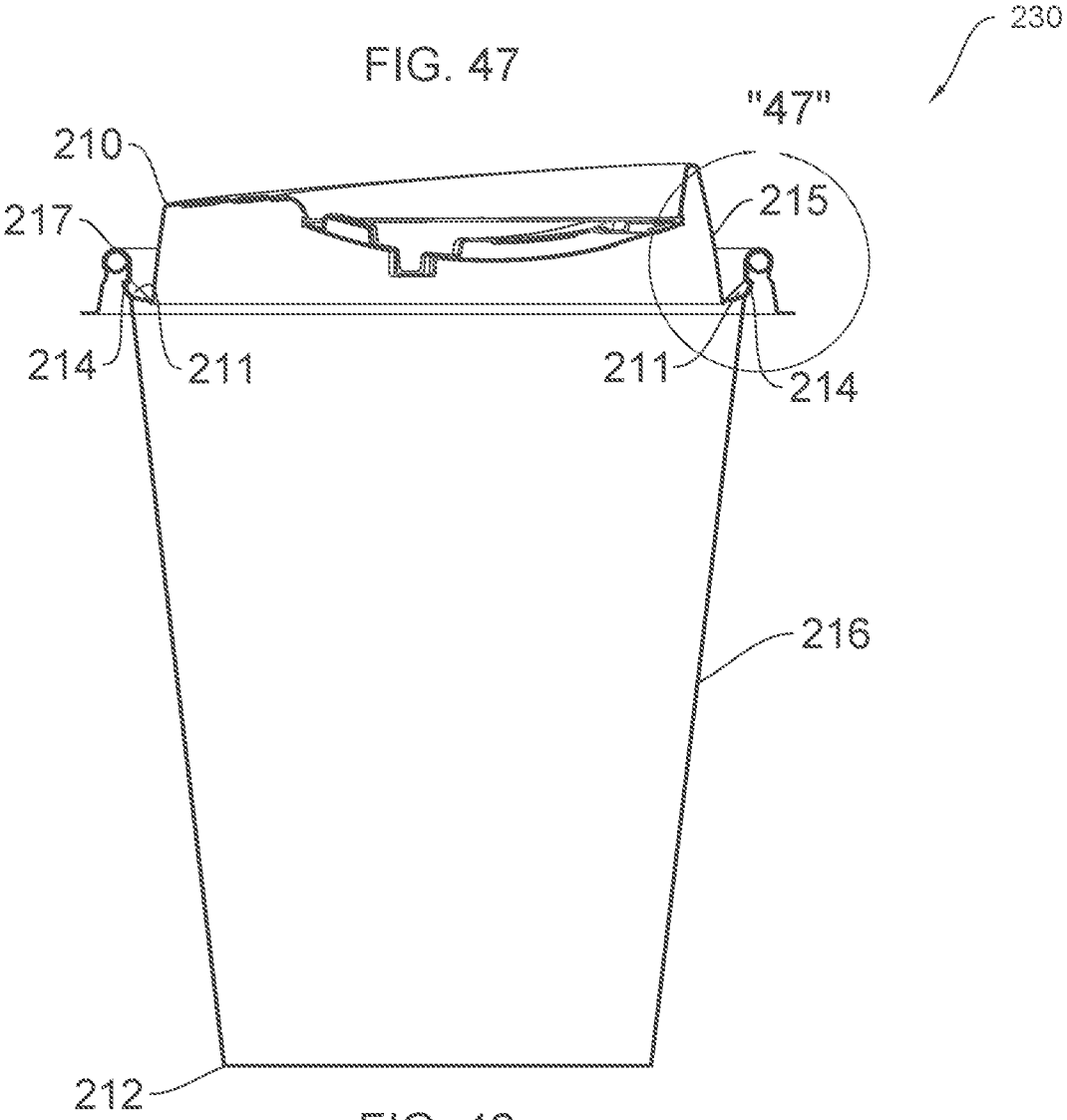

FIG. 46 is a longitudinal cross-sectional view of the third alternative pres sure-locking lid construction and container combination according to the present invention, the longitudinal cross-section being through select prong structures of the fourth alternative pressure-locking lid construction when in a prong-actuated engaged configuration.

Figure 47:
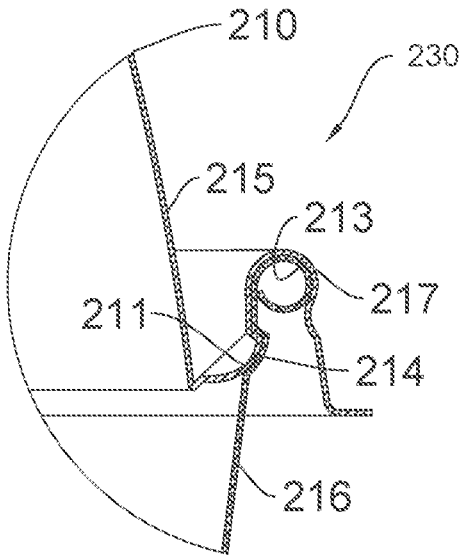

FIG. 47 is a fragmentary enlarged sectional view as sectioned from FIG. 46 to show in greater detail the structural formations at the junction site between a select prong structure and an upper container rim of the third alternative container when in the prong-actuated engaged configuration.

Figure 48:
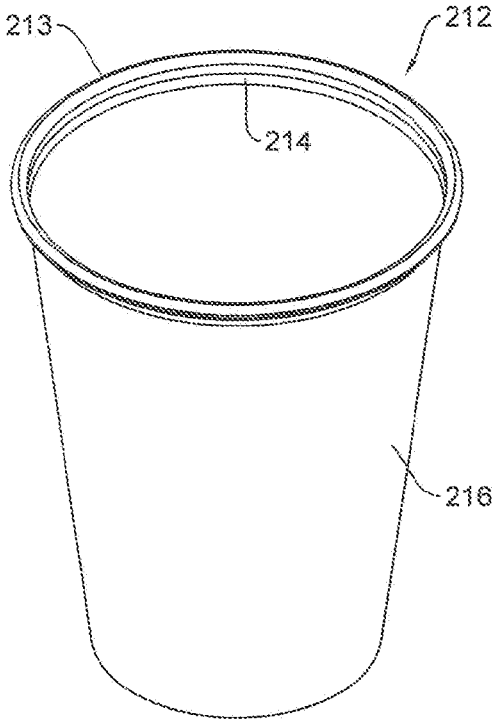

FIG. 48 is a top perspective view of the third alternative container according to the present invention.

Figure 49:
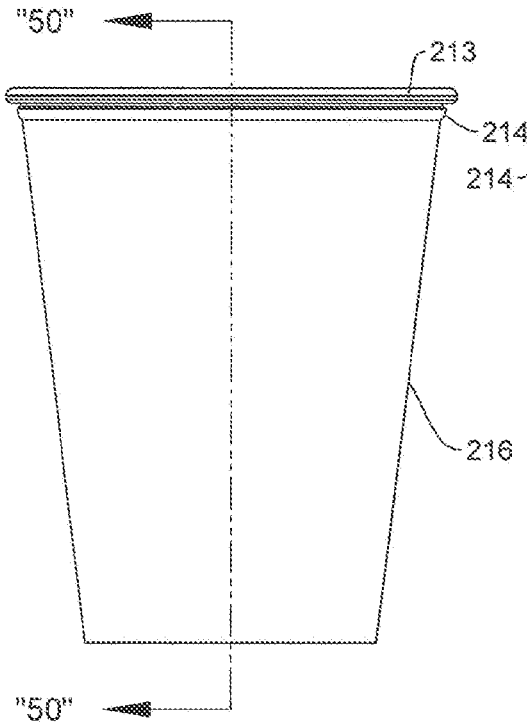

FIG. 49 is a side elevational view of the third alternative container according to the present invention.

Figure 50:
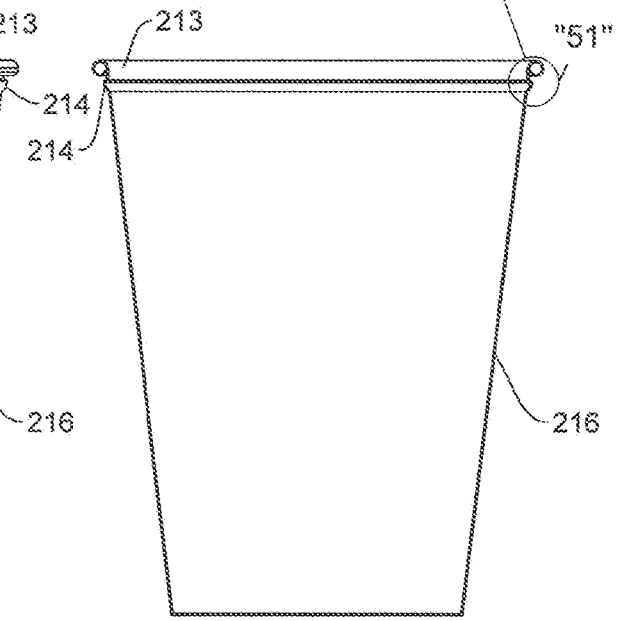

FIG. 50 is a longitudinal cross-sectional view of the third alternative container according to the present invention.

Figure 51:
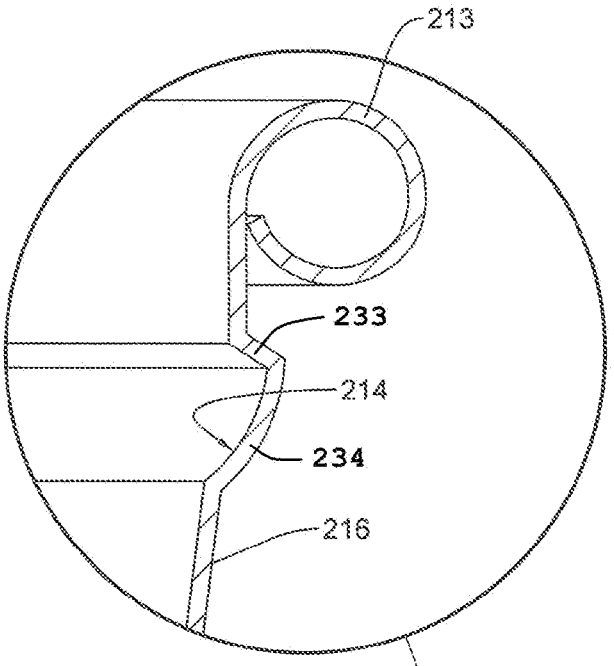

FIG. 51 is a fragmentary enlarged sectional view of the upper container rim and locking groove sites as sectioned from FIG. 50 to show in greater detail said features.

Figures 52, 53, 54, 55, 56, 56A:
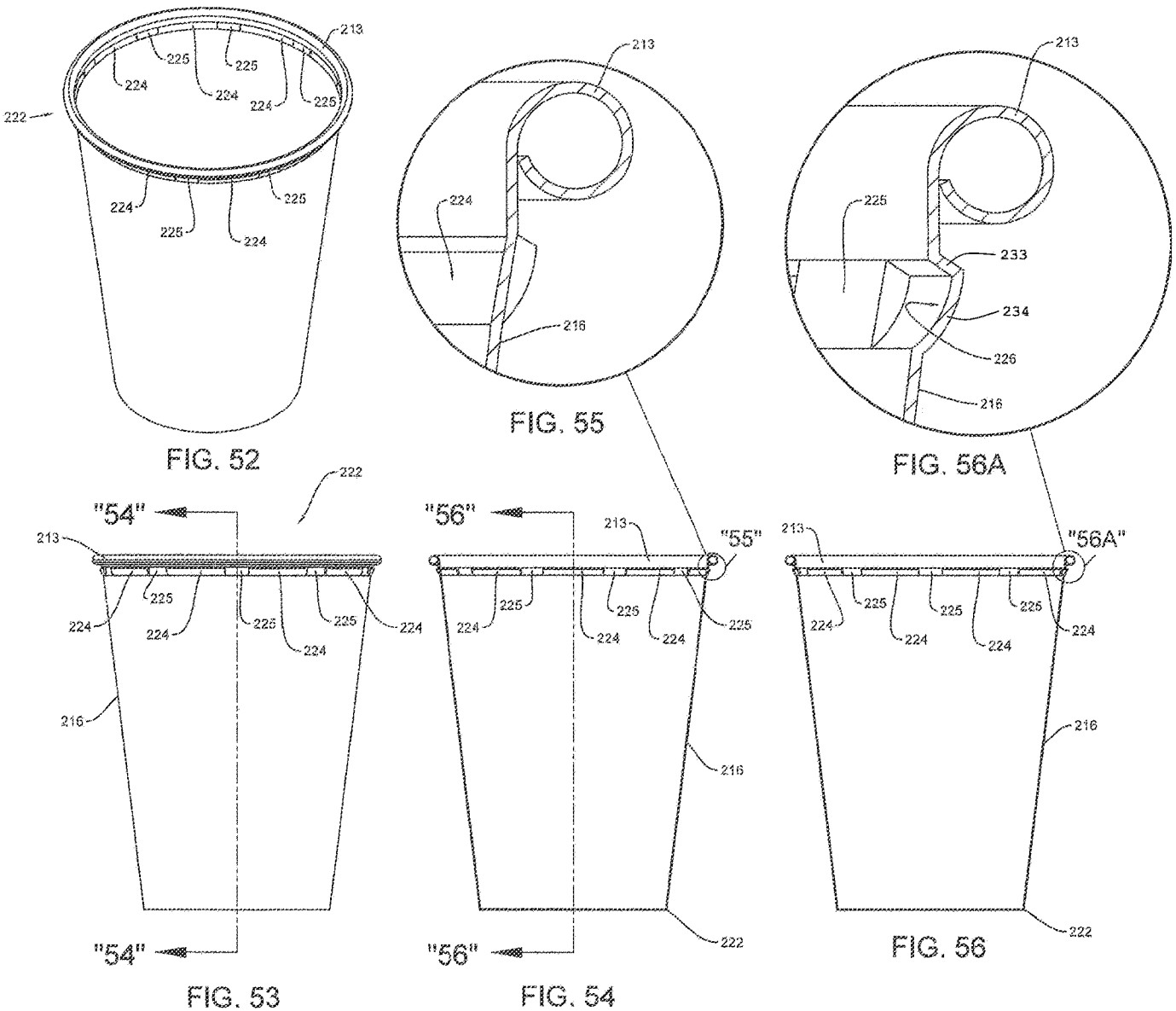

FIG. 52 is a top perspective view of a fourth alternative container according to the present invention, the fourth alternative container being usable in combination with the fourth alternative pressure-locking lid construction.

FIG. 53 is a side elevational view of the fourth alternative container according to the present invention.

FIG. 54 is a longitudinal cross-sectional view of the fourth alternative container according to the present invention as sectioned through a spacer section.

FIG. 55 is a fragmentary enlarged sectional view as sectioned and enlarged from FIG. 54 to show in greater detail the structural formations at the upper container rim and spacer section.

FIG. 56 is a longitudinal cross-sectional view of the fourth alternative container according to the present invention as sectioned through a locking cavity.

FIG. 56A is a fragmentary enlarged sectional view as sectioned and enlarged from FIG. 56 to show in greater detail the structural formations at the upper container rim and locking cavity.

Figure 57:
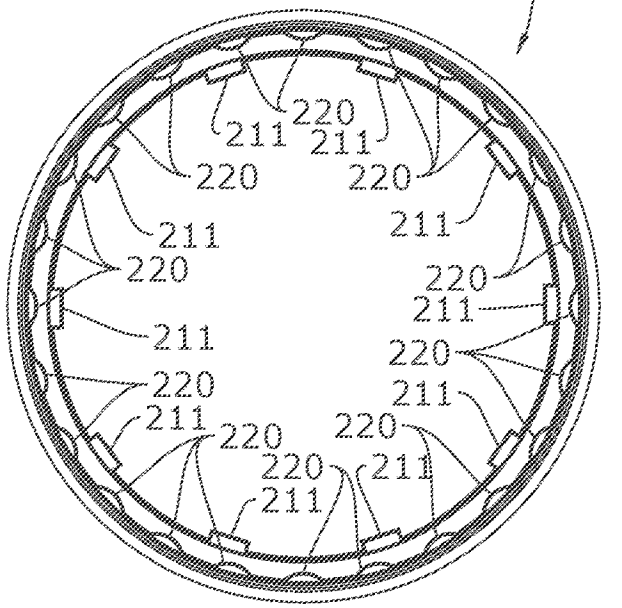

FIG. 57 is a bottom view of a fifth alternative pressure-locking lid construction according to the present invention, the fifth alternative pressure-locking lid construction comprising additional or secondary circumferentially spaced locking protrusions in addition to the prong structures.

Figure 58A:
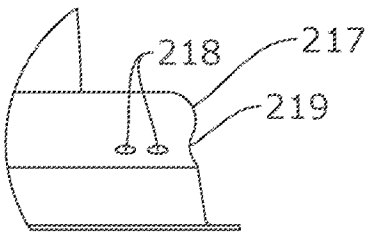
Figure 58:
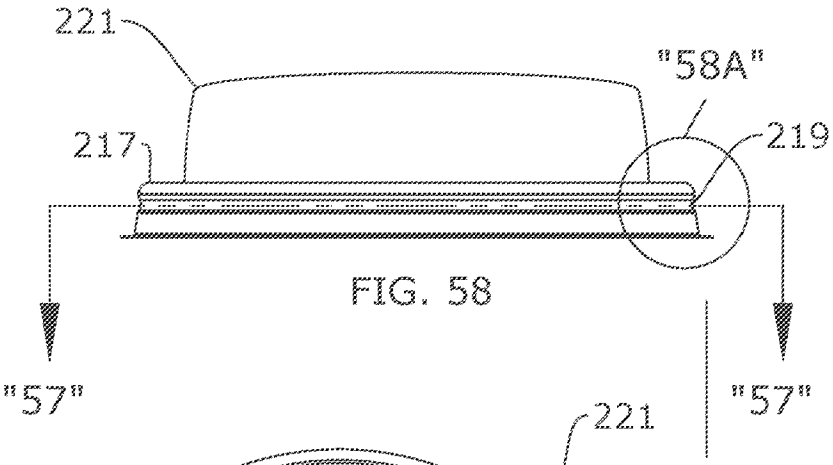

FIG. 58 is a side elevational view of the fifth alternative pressure-locking lid construction according to the present invention.

FIG. 58A is a fragmentary enlarged sectional view as sectioned and enlarged from FIG. 58 to show in greater detail the outside locking groove with indentations formed therein.

Figure 59:
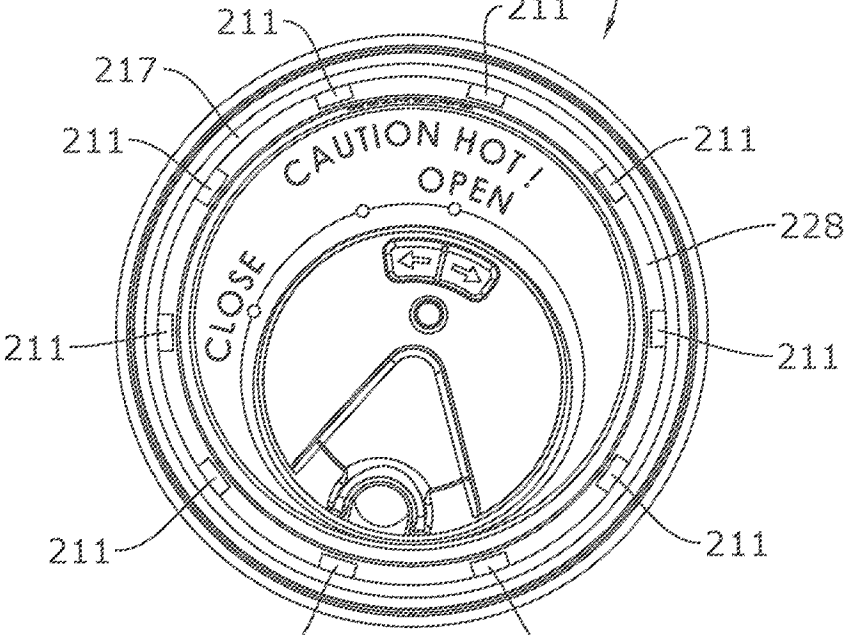

FIG. 59 is a top plan view of the fifth alternative pressure-locking lid construction according to the present invention.

DETAILED DESCRIPTION OF THE PREFERRED EMBODIMENTS

Referring now to the drawings with more specificity, the following specifications generally describe a number of lid-container combinations or assemblies operable for enhancing lid-to-container retention. FIG. 1, for example presents a posterior elevational view of a first alternative pressure-locking lid (and seam-removed) container combination 9 according to the present invention. FIG. 2 is a medial longitudinal cross-sectional view of the first alternative pressure-locking lid (and seam-removed) container combination 9 according to the present invention as sectioned from FIG. 1 and depicted in an assembled, but first or relaxed state or configuration.

Figure 2A:
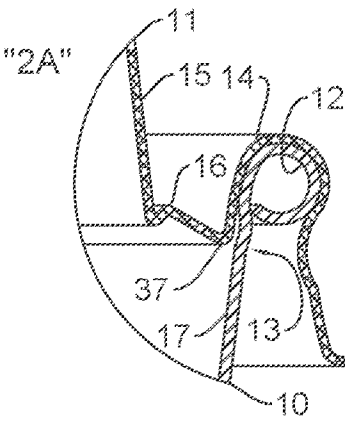
FIG. 2A is an enlarged, fragmentary sectional view of a container-to-lid junction site of the first alternative pressure-locking lid and seam-removed container combination according to the present invention as enlarged and sectioned from FIG. 2 to show in greater detail the structures associated with the container-to-lid junction site while in the first or relaxed state or configuration.
Figure 2:
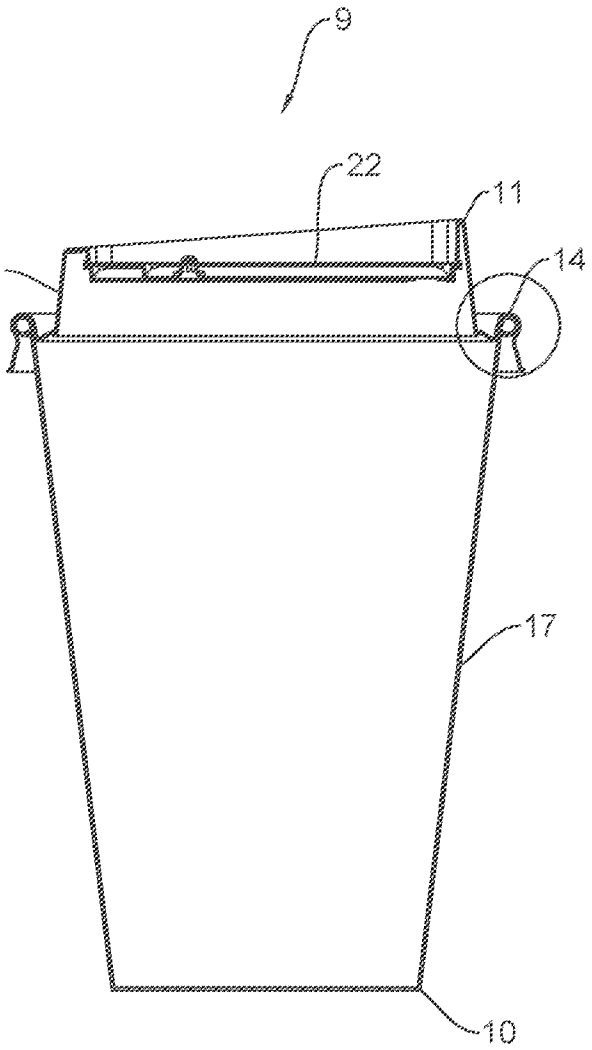
FIG. 2 is a medial longitudinal cross-sectional view of the first alternative pressure-locking lid and seam-removed container combination according to the present invention as sectioned from FIG. 1 and depicted in an assembled, but a first or relaxed state or configuration.

FIG. 2A is an enlarged, fragmentary sectional view of a container-to-lid junction site of the first alternative pressure-locking lid (and seam-removed) container combination 9 according to the present invention as enlarged and sectioned from FIG. 2 to show in greater detail the structures associated with the container-to-lid junction site while in the first or relaxed state or configuration. The first alternative pressure-locking lid (and seam-removed) container combination 9 preferably comprises a pressure-locking lid construction 11 in combination with a seam-removed container as at 10.

A radial groove or radially outwardly extending indentation as at 13 is formed from or at the interior side of the container wall 17 to accommodate or engage a lid rim bend or indentation-engaging formation 37. Several benefits of this assembly or combination include, but are not limited to the following. The pressure-locking lid construction 11 provides for a better and stronger fit on the container 10 whereby the grooved lid engagement rim 14 accepts or receives the upper container rim 12 and the lid rim bend or radially outer indentation-engaging portion 37 radially extends into the radial groove or radially outwardly extending indentation 13 thereby simultaneously gripping the container rim 12 from at least two directions or in at least two areas of the combination 9.

Figure 3A:
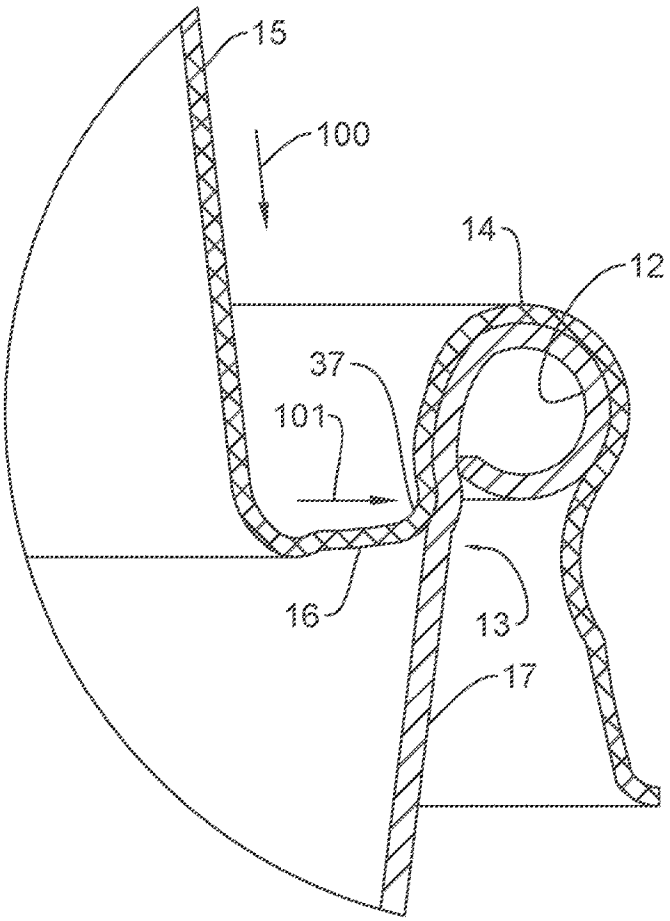
FIG. 3A is an enlarged, fragmentary sectional view of a container-to-lid junction site of the first alternative pressure-locking lid and seam-removed container combination according to the present invention as enlarged and sectioned from FIG. 3 to show in greater detail the structures associated with the container-to-lid junction site while in the second or actuated state or configuration.
Figure 3:
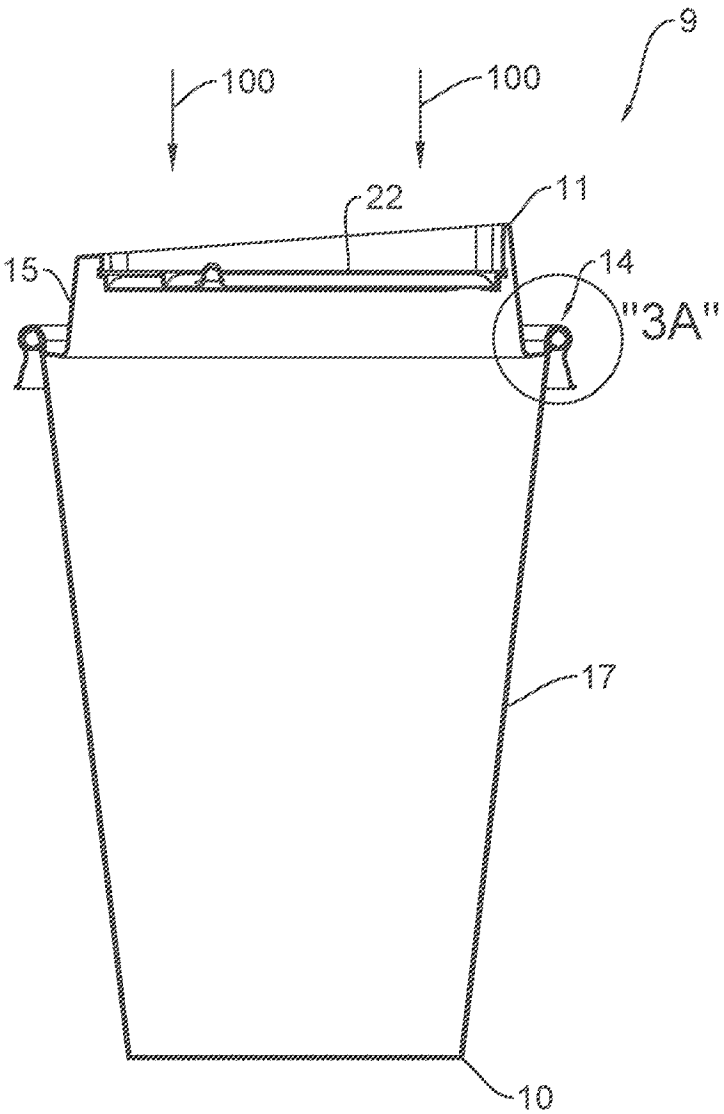
FIG. 3 is a medial longitudinal cross-sectional view of the first alternative pressure-locking lid and seam-removed container combination according to the present invention depicting the combination in an assembled, but a second or actuated state or configuration.

FIG. 3 is a medial longitudinal cross-sectional view of the first alternative pressure-locking lid (and seam-removed) container combination 9 according to the present invention depicting the combination in an assembled, but second or actuated state or configuration, which configuration is achieved by the application of force as generally depicted at downwardly directed arrows 100. FIG. 3A is an enlarged, fragmentary sectional view of a container-to-lid junction site of the first alternative pressure-locking lid (and seam-removed) container combination 9 according to the present invention as enlarged and sectioned from FIG. 3 to show in greater detail the structures associated with the container-to-lid junction site while in the second or actuated state or configuration with a downwardly directed arrow 100 and radially outwardly directed arrow 101 showing the applications of force. The reader is directed to lid rim bend or radially outer indentation-engaging portion 37 snugly fitting into or engaging with the radially inner groove or radially outwardly extending indentation 13 formed in the container wall 17 while under pressure or force as at vector 101.

FIG. 4 is a coronal longitudinal cross-sectional view of the first alternative pressure-locking lid (and seam-removed) container combination 9 according to the present invention depicting the combination 9 of elements 10 and 11 in the assembled second or actuated state or configuration the coronal or frontal longitudinal cross-section being made through a container seam junction as referenced at 18. FIG. 4A is an enlarged, fragmentary sectional view of a container-to-lid junction site of the first alternative pressure-locking lid (and seam-removed) container combination 9 according to the present invention as enlarged and sectioned from FIG. 4 to show in greater detail the structures associated with the container-to-lid junction site in superior adjacency to the seam junction where inner container material has been removed at the container seam 18 so as to render a smooth or flush surface 21 at the inner wall surface 38.

In this last regard, the reader is further directed to FIGS. 5 and 6. FIG. 5 is a diagrammatic depiction of a seamed container wall 17 with an exaggerated flare or seam site 19 adjacent a rotating (as at 104) implement or material removal tool as at 20 just before the rotating implement 20 is used to remove exaggerated seam site 19 material from an inner container surface 38 to render a smooth surface at an exaggerated seam site 19 of the seamed container wall 17. FIG. 6 is a diagrammatic depiction of the seamed container wall 17 just after the rotating implement 20 has been used to remove material from the inner container surface 38 to render a smooth or flush surface 21 at the exaggerated seam site 19 of the seamed container wall 17.

FIG. 7 is an enlarged, fragmentary sectional view of a container-to-lid junction site of the first alternative pressure-locking lid (and seam-removed) container combination 9 according to the present invention as enlarged and sectioned to show in greater detail the structures associated with the container-to-lid junction site, solid lining being utilized to highlight or depict the first or relaxed state or configuration and broken lining to highlight or depict the second or actuated state or configuration. The reader will note that upward bend 59 of element 16 migrates into a formation having a greater radius of curvature when directed into the actuated configuration depicted in broken lining.

It will thus be understood that FIGS. 1-7 attempt to depict a pressure-locking lid construction 11 in combination with a seam-removed container as at 10. A radial groove or radially outwardly extending indentation 13 is formed at the interior side of the container wall 17 to accommodate an indentation-engaging lid rim bend 37. Again referencing FIG. 3A, the container-to-lid junction site is depicted in the second or actuated state or configuration with a downwardly directed arrow 100 and a radially outwardly directed arrow 101 showing actuation of the wall-to-groove-traversing resilient portion or more simply resilient lid portion 16 (extending between the lid wall 15 and the lid rim 14) into an actuated configuration.

FIG. 7 depicts the resilient lid portion 16 in a relaxed configuration as at 16R in solid lining and an actuated configuration as at 16A in broken lining. It is contemplated that the resilient lid portion 16 may be preferably pressed to a maximum angle of roughly 5-10 degrees below the horizontal reference level as indicated at the 0-degree reference line 105. Angles less than 5 degrees from the reference level 105 create a less stable configuration resulting in a greater potential for the lid construction 11 to become removed from the container 10.

The actuable resilient lid portion 16 thereby creates a relatively more rigid combination 9 to limit or prevent an accidental "pop up" of the lid construction 11 by unintentional squeezing of the container 10. Further, this assemblage prevents or minimizes leaking or seeping of liquid at the paper joint area or site as at 18. The lid construction 11 is made easy to install since the relaxed configuration enables easy assembly. Once easily assembled, the lid construction 11 may be locked in place by way of the downward force as at arrows 100 and 101, and actuated state locking feature 59, which feature 59 is essentially a structural bend in the resilient lid portion 16 that straightens under actuation and holds the resilient lid portion 16 in the actuated state or configuration.

As indicated, a rotating 104 material removal tool as at 20 may be utilized to remove an inner raised seam material 19 at the inner container surface or wall 17 so as to render a smooth or flush surface 21 at the inner wall surface 38 at the seam site 18. The raised seam material 19 may be removed from that area located in superior adjacency to the seam site 18 at the inner wall surface 38 as generally depicted in FIG. 4A so that the lid construction 11 may better engage the groove 13 for preventing leakage or seepage via gaps created at the seam site 18 when the raised seam material is otherwise left in place.

FIG. 8 is a top plan view of the first alternative lid construction 11 according to the present invention as outfitted upon the first alternative container 10 to more particularly show a linearly displaceable slider element 22 for opening and closing the lid construction 11. FIG. 9 is a coronal or frontal longitudinal cross-sectional view of the first lid construction 11 otherwise depicted in FIG. 8 as assembled with the first alternative container construction 10. FIG. 10 is a top perspective view of the first lid construction 11 according to the present invention in assembled relation with the first alternative container construction 10 and depicting the linearly displaceable slider element 22 for opening and closing the lid construction 11.

FIG. 11 is an enlarged fragmentary sectional view as sectioned from FIG. 10 to show in greater detail the slider element 22 received in a laterally aligned groove 24 formed in the first alternative lid construction 11. FIG. 12 is an enlarged fragmentary sectional and exploded view to show in greater detail the slider element 22 exploded from the laterally aligned groove 24 formed in the first alternative lid construction 11. FIG. 13 is a top perspective view of the first alternative lid construction 11 depicting the linearly displaceable slider element 22 linearly displaced to an open state or configuration. FIG. 14 is a top perspective view of the first alternative lid construction 11 depicting the linearly displaceable slider element 22 linearly displaced to a closed state or configuration.

FIGS. 8-14 more particularly depict the linearly displaceable slider element 22 of the first alternative lid construction 11 as received (as at arrows 102) in a substantially linear insert-receiving formation 23 for effecting open-close functions. The prior art teaches a similar slider element in an assembly seen in the DIXIE® brand "Smart Top Reclosable Hot Cup Lid". The DIXIE® brand "Smart Top Reclosable Hot Cup Lid" teaches a substantially planar slider element. The linearly displaceable slider element 22 according to the present invention, however, preferably comprises a rounded, bowled, or radiused lower shape as at 26 for exerting pressure into the peripheral element-receiving groove 24 formed about the substantially linear insert-receiving formation 23. The formations 26 and 25 preferably comprise slightly different radiuses of curvature when in the relaxed, exploded states generally depicted in FIG. 12, the formation 26 having a slightly greater (second) radius of curvature as compared to the (first) radius of curvature of formation 25 and approximate one another when in the engaged configuration comparatively shown in FIG. 11 to provide for a more secure fitted relationship.

In other words, the rounded or radiused formation 26 cooperates with the rounded or radiused formation 25 of the main lid body thereby creating tight engagement. FIG. 12 depicts curved or radiused structures 25 and 26 in an unengaged position. Radiuses are slightly different, in order to exert pressure when both of these structures are engaged in an assembled position as in FIG. 11. As the reader will note in FIG. FIG. 13 (i.e. open position), a peripheral raised portion 39 is preferably formed around the liquid outlet 40. This peripheral raised portion 39 exerts extra pressure at this particular point when the linearly displaceable slider element 22 is in the closed position or configuration. The benefits of linearly displaceable slider element 22 and associated structure thus include, but are not limited to open and closed lid options being operable with one hand with a tight engagement to minimize or prevent leakage while the lid construction 11 is easy to manufacture and assemble, unlike slider lids with sliders from underneath as is the case with the DIXIE® brand "Smart Top Reclosable Hot Cup Lid", for example.

Referencing fragmentary, enlarged FIGS. 11A, 11B, and 12A, the reader will there consider a so-called "step-down formation" as at 51 and associated features. The step-down formation 51 is essentially L-shaped in vertically transverse cross-section and has an upper groove-engaging formation 52 extending in a first plane for insertion in edge-receiving groove 24, and a lower-spacing portion as at 53 extending in a second plane orthogonal to the first plane for spacing the lower slider element portion 54 with lower convex surfacing 55 from the first plane of the groove-engaging formation 52.

The step-down formation 51 effectively creates additional pressure between the lower convex surfacing 55 and the upper concave surfacing 56 of the slider element-receiving formation 25 of the insert-receiving formation 23 when the slider element 22 is received in the insert-receiving formation 23. A downward force is referenced at 121 with a normal force 122 indicating the enhanced pressure effect at the convex-to-concave surfacing interface as at arcuate line 57.

At the same time, the step-down formation 51 directs radially outwardly directed pressure or forces as at 123 with an opposing normal force 124 from the resilient return of the resiliently actuated linearly displaceable slider element 22 into the element-receiving groove 24 for enhancing the contact pressure between the linearly displaceable slider element 22 and the element-receiving groove 24 at the edge-to-groove interface as at line 58. Thus, the convex-to-concave interface 57 and the edge-to-groove interface 58 simultaneously provide leak proof sealing mechanisms orthogonally relative to one another as opposed to the DIXIE® brand "Smart Top Reclosable Hot Cup Lid".

Thus, it is believed certain novelty stems from the opposed arcuately shaped structures exhibiting convex to concave insert pressure as well as between the element-receiving groove 24 via the groove-engaging edge portion 52 of the step-down formation 51 for creating ultra-tight engagement between the element 22 and the insert-receiving structure 23. Analogous features are also presented in connection with embodiment shown in FIGS. 15-19 and the foregoing discussion is equally applicable in connection with those embodiments bearing the same reference numerals.

FIG. 15 is a top perspective view of a second alternative lower lid construction 27 according to the present invention showing an upper insert-receiving cavity 32 having a nub-receiving arc-length groove 33 formed therein, the second alternative lower lid construction 27 being a lower material construction with an upper insert 28 removed therefrom as otherwise depicted in FIG. 16. FIG. 16 is a bottom perspective view of the upper insert construction 28 according to the present invention as removed from the lower material construction 27 as otherwise depicted in FIG. 15 and outfitted with a groove-engaging nub 31 and an optional flavor patch 29 as received or outfitted within a raised (triangular) formation 34 of the upper insert construction 28.

FIG. 17 is an enlarged bottom perspective view of the optional flavor release patch 29 as removed from the upper insert construction 28 otherwise depicted in FIG. 16. FIG. 18 is a top perspective view of the second alternative lid construction 30 according to the present invention showing the upper insert construction 28 received in the insert-receiving cavity 32 of the lower lid construction 27 and depicting the hidden optional flavor release patch 29 in broken lining to show relative position of the optional flavor release patch 29 relative to the primary beverage outlet 35 of the second alternative lid construction 30 and directional arrows 103 depicting liquid path to the primary beverage outlet 35 via the optional flavor release patch 29. FIG. 19 is a bottom perspective view of the upper insert construction 28 depicting the optional flavor release patch 29 in solid lining to show relative position of the optional flavor release patch 29 relative to the primary beverage outlet 35 of the second alternative lid construction 30 and directional arrows 103 depicting liquid path to the primary beverage outlet 35 via the optional flavor release patch 29.

Comparatively referencing FIGS. 15-19, the reader will there consider an exemplary hexagonally shaped flavor release patch 29 preferably formed as part of or attachable to the second alternative lid construction 30. The shape of the flavor release patch 29 need not be hexagonal, but could be round or any other shape. The flavor release patch 29 may be attached (by a manufacturer or by a user) to the underside of an upper insert construction 28 within the raised triangular protrusion or formation 34. Liquid flows as at arrows 103 around the flavor release patch 29 function to wash off small flavor particles as at 36 that mix with the liquid flow 103 as it progresses to the liquid outlet 35 as generally depicted in FIGS. 18 and 19. The flavor patch 29 could be provided with different flavors and different disk colors, for example: Green—Irish Cream, Blue—Vanilla, Orange—Hazelnut, etc.

Referencing FIGS. 15, 16, and 19, and comparing these views to FIGS. 11 and 12, the reader will please consider that surfacing 41 and 42 of the lower and upper elements 27 and 28 are respectively akin to formations 25 and 26 insofar as the insert element 28 preferably comprises a rounded or concave lower shape or surfacing as at and an outer peripheral edge 43 that respectively exert pressure into convex surfacing 41 and edge-receiving groove 44 formed in peripheral adjacency to the concave, bowl-shaped cavity formation 32. The upper lid construction is thus seatable atop the lower lid construction such that the lower convex surfacing and upper concave surfacing together form a spherical surface-to-surface seal and enable slidable open-close functionality.

The formation surfacing 41 and 42 preferably comprise slightly different radiuses of curvature when in the relaxed states, but approximate one another when in the engaged configuration comparatively shown in FIG. 18 for exerting pressure on the radial groove 44 via an outer edge 43 of the element 28 for preventing the element 28 from becoming inadvertently removed from the concave, bowl-shaped cavity formation or depression 32 and creates a tighter/leak proof engagement of concave surfacing 41 and convex surfacing 42 limiting liquid migration therebetween. The upper lid construction is preferably and resiliently actuable when seated atop the lower lid construction for enhancing seated engagement therebetween.

The linearly displaceable slider element 22 and insert element 28 move relatively easier relative to the lower material constructions 23 and 27 when a hot liquid is received in the beverage container(s) as at 10. The relatively elevated temperature of the liquid expands the material construction ever so slightly, but of a sufficient degree so as to enable the slide element 22 and insert element 28 an eased linear displacement or rotative movement. This enhanced functionality follows the form of the lid constructions according to the present invention and allows or provides for a tighter engagement when not in a serving or open position and a looser engagement when the user wishes to displace the slider element 22 or rotate the insert element 28 relative the lower lid construction(s).

FIG. 20 is a first sequential longitudinal cross-sectional view of a second alternative pressure-locking lid construction and container combination 50 according to the present invention. FIG. 20A is an enlarged fragmentary sectional view of the pres sure-locking lid construction and container combination 50 according to the present invention as sectioned from FIG. 20 to show in greater detail structures associated with the junction site between the upper pressure-locking lid construction 111 and the lower container 110 before the lid construction 111 is pressure-locked thereto. The reader is directed to a lid rim-receiving groove 118 receiving an upper container rim 119 of the container 110; a locking groove or radially outwardly extending indentation 112 formed in the container wall 109 of the container 110; the downwardly and outwardly protracted locking ridge or indentation-engaging structure 113 of the lid construction 111 that engages the locking groove or radially outwardly extending indentation 112. The downwardly and outwardly protracted locking ridge or indentation-engaging structure 113 is depicted in a pre-engaged state or configuration in FIG. 20A.

FIG. 21 is a second sequential longitudinal cross-sectional view of the second alternative pressure-locking lid construction and container combination 50 according to the present invention. FIG. 21A is an enlarged fragmentary sectional view of the second alternative pressure-locking lid construction and container combination 50 according to the present invention as sectioned from FIG. 21 to show in greater detail structures associated with the junction site between the upper pressure-locking lid construction 111 and the lower container 110 as the lid construction 111 is pressure-locked into engagement with the lower container 110. The reader is directed to a depiction of how the locking downwardly and outwardly protracted locking ridge or indentation-engaging structure 113 engages the locking groove or radially outwardly extending indentation 112 formed at the container wall 109 of the container 110. The locking downwardly and outwardly protracted locking ridge or indentation-engaging structure 113 is directed radially outwardly as the lid top 114 is directed downward, the downwardly directed force 1000 being transferred into the locking downwardly and outwardly protracted locking ridge or indentation-engaging structure 113 via the pivotable lid portion 115 pivotable about point 1010.

FIG. 22 is a third sequential longitudinal cross-sectional view of the second alternative pressure-locking lid construction and container combination 50 according to the present invention. FIG. 22A is an enlarged fragmentary sectional view of the second alternative pressure-locking lid construction and container combination 50 according to the present invention as sectioned from FIG. 22 to show in greater detail structures associated with the junction site between the upper pressure-locking lid construction 111 and the lower container 110 as the lid construction 111 resiliently returns to a statically actuated configuration with the lower container 110.

The reader is directed to a depiction of how the radius of curvature of the locking downwardly and outwardly protracted locking ridge or indentation-engaging structure 113 decreases as the lid top 114 is directed upwardly as at 1020 and the wall-to-groove-traversing resilient portion or more simply resilient, pivotable lid portion 115 pivots into a relatively greater angle 1030 relative to angle 1040 of the lid wall portion 116 about pivot point 1010. The reader will further note the maintenance of outwardly directed force 1050 when in this engaged, pressure-locked, statically actuated configuration. The upwardly directed force 1020 may stem or result from a build-up of steam-based pressure 1115 within the space 120 of a fully enclosed hot beverage container 110 especially when the container 110 is filled with hot liquid to the maximum and while in a serving position. In this regard, the reader is further directed to comparatively reference FIGS. 27 and 28.

FIGS. 23, 24, and 25 respectively re-present or re-depict FIGS. 20A, 21A, and 22A in side-by-side relation for comparison purposes. FIGS. 26-28 respectively and comparatively depict absorption of (i.e. structural adaptation relative to) pressure 1115 within the space 120 created by hot liquid 1100 inside the enclosed container 110 by a flexible, membrane-like lid structure 117. The liquid temperature affects performance by lowering plastic internal resistance thereby creating permanent state of the "engaged position" by forcing the locking ridge structure toward locking groove or radially outwardly extending indentation 112 via wall-to-groove-traversing resilient portion or more simply, the resilient lid portion 115.

In other words, the hotter the liquid 1100, the more flexible the plastic material construction, and thus an increase in pressure from the liquid steam is absorbed and redirected by membrane like structure 117 so as to force locking downwardly and outwardly protracted locking ridge or indentation-engaging structure 113 into the locking groove or radially outwardly extending indentation 112 for enhancing the seal therebetween. The importance of this feature is specifically relevant when lid construction 111 is served in a fully closed position and air hole is closed, to limit any maximally hot liquid to spill through air hole or main aperture. The wall-to-groove resilient portion 115 may thus be said to be preferably further configured to direct the lid-locking indentation-engaging portion 113 radially outwardly when lidded container contents are heated or under pressure for further maximizing lid-to-container retention.

The reader will further note that the lid construction 111 may be attached to the cup or container 110 in both an unlocked/engaged position as generally depicted in FIGS. 20 and 26 or in a locked/engaged position as generally depicted in FIGS. 22, 27, and 28. When the lid construction 111 is pressed on the container 110 as depicted in FIGS. 21 and 21A, the horizontally extended locking indentation-engaging portion 113 deforms under pressure with or against the container wall 109 at locking groove or radially outwardly extending indentation 112, and preferably protracts upwardly and outwardly into the locking groove or radially outwardly extending indentation 112 of the container wall 109 thereby enhancing gripping power of locking mechanism.

The reader will further note the air pocket or space 1200 defined in superior adjacency to the locking ridge 113 and groove or radially outwardly extending indentation 112 when in the pressure-locked or actuated state. The air pocket or space 1200 operates to create an insulative air zone that operates to further enhance the lid-to-container seal. An air pocket or space 1200 may thus be said to be preferably defined in superior adjacency to an area of engagement between the radially outwardly extending indentation and the lid-locking bend or indentation-engaging portion 113 when in the actuated configuration for enhancing a lid-to-container seal.

FIG. 29 is a top plan view of the pressure-locking lid construction 111 according to the present invention as attached to a lower container 110. FIG. 30 is a top perspective view of the pressure-locking lid construction and container combination 50 according to the present invention. FIG. 31 is a side elevational view of the pressure-locking lid construction and container combination 50 according to the present invention.

FIG. 32 is a longitudinal cross-sectional view of a pressure-locking lid construction and container combination 50 according to the present invention as sectioned from FIG. 31. FIG. 32A is an enlarged fragmentary sectional view of the pressure-locking lid construction and container combination 50' according to the present invention as sectioned from FIG. 32 to show in greater detail structures associated with the junction site between the upper pressure-locking lid construction 111 and the lower container 110 in the static configuration with the lower container 10 in an iteration of the combination 50' where space 1200 has been structurally eliminated from the actuated, pressure-locked configuration there depicted thus denoting the combination 50' in distinction to combination 50.

FIG. 33 is a fragmentary longitudinal sectional view of the pressure-locking lid construction and container combination 50' according to the present invention showing a second pressure-locking lid construction 111 exploded from the lower combination 50' with a first pressure-locking lid construction 111 in a pre-actuated or pre-engaged state or configuration. The reader will note that resilient, pivotable lid portion 115 is angled upwardly relative to pivot point 1010. FIG. 33A is an enlarged fragmentary section view of the pressure-locking lid construction and container combination 50 as sectioned from FIG. 33 to show in greater detail directional force 1110 directed into the locking ridge structure 113 as the pressure-locking lid construction 111, as pre-engaged, engages the lower container 110.

FIG. 34 is a fragmentary longitudinal sectional view of the pressure-locking lid construction and container combination 50' according to the present invention with the pressure-locking lid construction 111 in an engaged, static configuration. FIG. 34A is an enlarged fragmentary section view of the pressure-locking lid construction and container combination 50' as sectioned from FIG. 34 to show in greater detail directional force 1050 directed into the locking groove or radially outwardly extending indentation 112 when in the static configuration.

FIG. 35 is a further enlarged fragmentary section view of the pressure-locking lid construction and container combination 50' as enlarged from FIG. 33A to show in still greater detail directional force 1110 directed into the relaxed/undeformed locking ridge structure 113 as the pressure-locking lid construction 111 engages the lower container 110. FIG. 36 is a further enlarged fragmentary section view of the pressure-locking lid construction and container combination 50' as enlarged from FIG. 34A to show in still greater detail directional force 1050 directed into the locking groove or radially outwardly extending indentation 112 via the actuated/deformed locking indentation-engaging portion 113 when in the static configuration. FIGS. 32-36 generally and comparatively depict a pre-engaged pressure-locking lid construction 111 attached to the lower container 110. The locking indentation-engaging portion 113 is slightly upwardly deformed from the pressure/contact with the wall of the cup/container 110 thereby enhancing the gripping effect of the lid construction 111.

FIG. 37 is a top plan view of a third alternative pressure-locking lid construction 210 according to the present invention showing a series of equally spaced, peripherally or circumferentially arranged prong structures 211 formed in radially inner adjacency to the rim-engaging groove 217 of the lid construction 210. FIG. 38 is a top perspective view of the third alternative pressure-locking lid construction 210 according to the present invention further depicting the series of equally-spaced, peripherally or circumferentially arranged prong structures 211 formed in radially inner adjacency to the rim-engaging groove 217 of the lid construction 210. The prong structures 211 are arranged in resilient structure 228, which structure 228 is structurally akin to resilient structure 16 and resilient, pivotable portion or structure 115.

FIG. 39 is a cross-sectional view of the pressure-locking lid construction 210 according to the present invention as sectioned from FIG. 37 adjacent to prong structures 211 for the purpose of highlighting structural formations therethrough. FIG. 39A is a fragmentary enlarged sectional view as sectioned from FIG. 39 to show in greater detail the structural formations adjacent a select prong structure 211. FIG. 40 is a cross-sectional view of the pressure-locking lid construction 210 according to the present invention as sectioned from FIG. 37 through prong structures 211 for the purpose of highlighting structural formations therethrough.

FIG. 40A is a fragmentary enlarged sectional view as sectioned from FIG. 40 to show in greater detail the structural formations at a select prong structure 211. FIGS. 37-40A generally depict the prong structures 211 in a pre-engaged or pre-actuated configuration. FIGS. 41 and 42 depict the pressure-locking lid construction 210 attached to a lower container 212 such that the rim-receiving groove 217 of the lid construction receives the upper rim 213 of the lower container 212. The container wall 216 of the lower container 212 preferably comprises a prong-receiving formation or radially outwardly extending indentation as at 214 in inferior adjacency to the container rim 213.

More particularly, FIG. 41 is a longitudinal cross-sectional view of a pressure-locking lid construction and container combination 230 according to the present invention comprising pressure-locking lid construction 210 in combination with lower container 212. The longitudinal cross-section of FIG. 41 is through select prong structures 211 of the pressure-locking lid construction 210 when in a prong-relaxed engaged configuration. FIG. 42 is a fragmentary enlarged sectional view as sectioned from FIG. 41 to show in greater detail the structural formations at the junction site between a select prong structure 211 and the upper container rim 213 of the container 212 when in the prong-relaxed engaged configuration.

FIG. 43 is a longitudinal cross-sectional view of the pressure-locking lid construction and container combination 230 according to the present invention, the longitudinal cross-section being through select prong structures 211 of the pressure-locking lid construction 210 when in a prong-actuated, engaged configuration. A pre-actuated configuration is depicted in broken lining and a post-actuated configuration is depicted in solid lining for comparison purposes.

FIG. 44 is a fragmentary enlarged sectional view as sectioned from FIG. 43 to show in greater detail the structural formations at the junction site between a select prong structure 211 and the upper container rim 213 of the container 212 when in the prong-actuated, engaged configuration. The prong-relaxed configuration of the select prong structure 211 is again more clearly shown in broken lining for comparison purposes. The reader will note that the locking groove formation or radially outwardly extending indentation 214 formed in the wall 216 of the container 212 is sized and shaped to match the size and shape of the select prong structure 211.

FIG. 45 is a fragmentary further enlarged sectional view as further enlarged from FIG. 44 to show in still greater detail the structural formations at the junction site between a select prong structure 211 and the upper container rim 213 of the container 212 when in the prong-actuated engaged configuration as referenced at 211A, the prong-relaxed configuration 211R of the select prong structure 211 being shown in broken lining for comparison purposes. The radially outer indentation-engaging portion or select prong structure 211 preferably comprises a planar upper prong portion as at 231 and an arcuate lower prong portion as at 232. The reader will note the pivot point 2100 intermediate the select prong structure 211 and the lid wall portion 215.

Further, locking groove or radially outwardly extending indentation 214 is formed in the wall 216 of the container 212 so as to be sized and shaped to match the size and shape of the select prong structure 211 as it is received therein such that the select prong structure 211 snugly snaps into actuated configuration within the locking groove or radially outwardly extending indentation 214. The reader will note that the radially outwardly extending indentation 214 preferably comprises a planar upper indentation portion as at 233 and an arcuate lower indentation portion as at 234. The planar upper prong portion 231 is flush with the planar upper indentation portion 233 and the arcuate lower prong portion 232 is flush with the arcuate lower indentation portion 234 when in the actuated configuration.

FIG. 46 is a longitudinal cross-sectional view of the pressure-locking lid construction and container combination 230 according to the present invention, the longitudinal cross-section being through select prong structures 211 of the pressure-locking lid construction 210 when in a prong-actuated engaged configuration. FIG. 47 is a fragmentary enlarged sectional view as sectioned from FIG. 46 to show in greater detail the structural formations at the junction site between a select prong structure 211 and the upper container rim 213 of the container 212 when in the prong-actuated engaged configuration. The reader will again note that the locking groove formation or radially outwardly extending indentation 214 formed in the wall 216 of the container 212 is sized and shaped to match the size and shape of the select prong structure 211 such that the select prong structure 211 snugly snaps into actuated configuration within the groove formation or radially outwardly extending indentation 214.

FIG. 48 is a top perspective view of the lower container 212 according to the present invention, the lower container 212 being usable in combination with the pressure-locking lid construction 210 and providing the locking groove formation or radially outwardly extending indentation 214 formed in the container wall 216 for snap-receiving the prong structures 211 when pressure is applied in a downward direction as at arrows 1011 to the lid construction 210 to actuate and lock the lid construction 210 into engagement with the container 212. The reader will note the locking groove formation or radially outwardly extending indentation 214 is preferably and continuously smooth circumferentially or peripherally in inferior adjacency to the upper container rim 213.

FIG. 49 is a side elevational view of the container 212 according to the present invention. As stated the container 212 is usable in combination with the pressure-locking lid construction 210 and is presented in side elevational view to better highlight the locking groove formation or radially outwardly extending indentation 214 formed in the container wall 216 for snap-receiving the prong structures 211 when pressure is applied in a downward direction as at 1011 to the lid construction 210 to actuate and lock the lid construction 210 into engagement with the container 212. FIGS. 50 and 51 further attempt to highlight the locking groove formation or radially outwardly extending indentation 214 formed in inferior adjacency to the upper container rim 213 in the container wall 216 with transverse cross-sectional shaped and dimensioned to receive the prong structures 211 when re-configured into an actuated state or configuration.

FIG. 52 is a top perspective view of an alternative lower container 222 according to the present invention also usable in combination with the pressure-locking lid construction 210 and providing circumferentially spaced locking cavities 224 formed in the container wall 216 for snap-receiving the circumferentially spaced prong structures 211 when pressure is applied in a downward direction 1011 to the lid construction 210 to actuate and lock the lid construction 210 into engagement with the alternative lower container 222. The reader will note the locking cavities 224 are periodically spaced and thus are structurally different than the continuously smooth locking groove formation or radially outwardly extending indentation 214 of the lower container 212. Spacer sections 225 break the otherwise smooth continuity between circumferentially adjacent locking cavities 224.

FIG. 53 is a side elevational view of the lower container 222 according to the present invention usable in combination with the pressure-locking lid construction 210 and providing circumferentially spaced locking cavities 224 formed in the container wall 216 for snap-receiving the circumferentially spaced prong structures 211 when pressure is applied in a downward direction 1011 to the lid construction 210 to actuate and lock the lid construction 210 into engagement with the alternative lower container 222. FIGS. 54 through 56A attempt to further attempt to highlight the locking cavities 224 formed in inferior adjacency to the upper container rim 213 in the container wall 216 transversely shaped and dimensioned to individually receive the prong structures 211 when re-configured into an actuated state or configuration.

FIG. 57 is a bottom view of an alternative pressure-locking lid construction 221 according to the present invention. The second pressure-locking lid construction 221 comprising additional or secondary circumferentially spaced locking protrusions 220 in addition to prong structures 211. The locking protrusions 220 are located on the outside of the locking ring 219 extending radially inwardly therefrom. Locking protrusions 220 provide a relatively stronger grip on containers as at 210 or 222. The locking formations 220 are formed by indenting (as at 218) the locking ring 219 with exemplary dimensions as follows: 0.003-0.015 inches depth; 0.1-0.5 inches length; and 0.03-0.1 inches width. The indentations 218 are thus relatively small in magnitude and periodic or not continuous thus making it possible to form with state-of-the-art thermoforming processes. FIGS. 58 and 58A comparatively attempt to highlight the external indentations 218 that form protrusions 220 internally as otherwise depicted in FIG. 57. FIG. 59 is a top plan view of the alternative pressure-locking lid construction 221 according to the present invention highlighting the periodically and circumferentially spaced prong structures formed in the resilient structure 228.

While the above descriptions contain much specificity, this specificity should not be construed as limitations on the scope of the invention, but rather as an exemplification of the invention. In certain alternative embodiments, the basic invention may be said to essentially teach or disclose a liquid lid-container assembly or combination (as at combinations 9, 50, and 230) for maximizing lid-to-container retention or for maximizing container lid retention relative to the liquid container when outfitted thereupon. The liquid lid-container assembly according to the present invention preferably comprises, in combination a liquid container and a container lid as variously exemplified and referenced.

The liquid container according to the present invention is believed to essentially and preferably comprise an upper container rim and a container wall extending downwardly from the upper container rim. Notably, the container wall comprises a radially outwardly extending indentation or groove formed in inferior adjacency to the upper container rim. The radially outwardly extending indentation or groove is believed variously referenced at groove 13, locking groove 112, and prong-receiving formation 214. The container lid essentially comprises a rim-receiving groove, a radially inner lid wall, and a wall-to-groove-traversing resilient portion.

The wall-to-groove-traversing resilient portion as variously referenced at 16, 115, and 228 traverses a structural distance between the upright lid wall and the rim-receiving groove and is resiliently actuable intermediate a relaxed configuration and an actuated configuration. The distance traversing resilient portion comprises a radially outer indentation-engaging portion as variously referenced at lid rim bend 37, locking ridge structure 113, and prong structures 211. The rim-receiving groove receives the upper container rim, and the radially outer indentation-engaging portion engages the radially outwardly extending indentation when in the actuated configuration. Thus, the rim-receiving groove and the radially outer indentation-engaging portion together lock the container lid to the liquid container for cooperatively maximizing lid-to-container retention.

The upright, radially inner lid wall and wall-to-groove resilient portion are directable toward the liquid container from the relaxed configuration for reconfiguring the wall-to-groove resilient portion into the actuated configuration as generally depicted in FIGS. 7, 21A, 24, 43, 44, and 45. The radially outer lid-locking bend or radially outer indentation-engaging portion is directable radially outwardly into engagement with the radially outwardly extending indentation when the wall-to-groove resilient portion is reconfigured into the actuated configuration.

The container wall may preferably comprise a stepped seam section at inner surfacing thereof, which stepped seam section is structurally modified by removing material therefrom for providing flush surfacing at the radially outwardly extending indentation as generally depicted in FIGS. 4-6. The container lid may preferably comprises a lower lid construction and an upper lid construction, wherein the lower lid construction comprises upper concave surfacing, and the upper lid construction comprises lower convex surfacing. The upper lid construction is seatable atop the lower lid construction such that the lower convex surfacing and upper concave surfacing together form a spherical surface-to-surface seal and enable slidable open-close functionality. Preferably, the upper lid construction is resiliently actuable when seated atop the lower lid construction for enhancing seated engagement therebetween.

The container lid comprises a lower lid construction, an upper lid construction, and a flavor release patch as at flavor patch element 29, which element 29 is receivable intermediate the lower and upper lid constructions. The flavor release patch basically functions to release flavor-enhancing particles as at 36 when liquid is directed thereby before exiting a primary outlet as at 35 formed in the upper lid construction.

An air pocket may be preferably defined in superior adjacency to an area of engagement between the radially outwardly extending indentation and the lid-locking bend or indentation-engaging portion when in the actuated configuration for enhancing a lid-to-container seal. The wall-to-groove resilient portion is preferably further configured to direct the lid-locking bend or indentation-engaging portion radially outwardly when lidded container contents are heated for further maximizing lid-to-container retention.

The wall-to-groove resilient portion may further preferably comprise a series of circumferentially spaced prong structures in certain embodiments. The series of circumferentially spaced prong structures are preferably receivable in the radially outwardly extending indentation when actuated into the actuated configuration for further maximizing lid-to-container retention. The radially outwardly extending indentation may further preferably comprise a series of circumferentially spaced prong-receiving cavities for receiving the series of circumferentially spaced prong structures when the wall-to-groove resilient portion is configured into the actuated configuration for further maximizing lid-to-container retention.

Stated another way, the present invention may be said to most essentially teach or describe a lid-to-container locking combination for maximizing lid-to-container retention, which lid-to-container locking combination preferably and essentially comprises a container and a container lid. The container preferably comprises an upper container rim and a container wall, the container wall comprising an inner first matable formation exemplified by the radially outwardly extending indentation(s).

The container lid preferably comprises a resilient portion that is resiliently actuable intermediate a relaxed configuration and an actuated configuration and comprises an outer second matable formation exemplified by the radially outer indentation engaging portion. The outer second matable formation is matable with the inner first matable formation when the resilient portion is directed into the actuated configuration. The inner first and outer second matable formations thus cooperably function to lock the container lid to the container for maximizing lid-to-container retention.

Preferred optional features according to the present invention include a process of structurally modifying the stepped seam section of the container wall by removing material therefrom for providing flush surfacing at the inner first matable formation for enhancing maximized lid-to-container retention. Further, the container lid may preferably comprise a lower lid construction and an upper lid construction such that the lower lid construction comprises upper concave surfacing and the upper lid construction comprises lower convex surfacing. The upper lid construction is seatable atop the lower lid construction such that the lower convex surfacing and upper concave surfacing form a spherical surface-to-surface seal and enable slidable open-close functionality.

Noting that the container lid comprises a lower lid construction and an upper lid construction, it is further contemplated that the container lid (assembly) may comprise a flavor release patch receivable intermediate the lower and upper lid constructions. The flavor release patch basically functions to release flavor-enhancing particles when liquid is directed thereby before exiting a primary outlet formed in the upper lid construction.

Accordingly, although the inventive lid-container combinations or assemblies according to the present invention have been described by reference to a number of different embodiments, it is not intended that the novel combinations or assemblies be limited thereby, but that modifications thereof are intended to be included as falling within the broad scope and spirit of the foregoing disclosure, the appended drawings, and perhaps most importantly, the following claims.

What is claimed is:

1. A container lid assembly for a liquid container, the container lid assembly comprising:

a lower lid construction and a linearly displaceable slider element, the lower lid construction comprising a linear insert-receiving formation and a liquid outlet, the linearly displaceable slider element being receivable in the linear insert-receiving formation and linearly displaceable relative to the lower lid construction for opening and closing the liquid outlet;

the lower lid construction further comprising upper concave surfacing at the linear insert-receiving formation and the linearly displaceable slider element comprising lower convex surfacing, the linearly displaceable slider element being seatable atop the lower lid construction within the insert-receiving formation such that the lower convex surfacing and upper concave surfacing form a radiused convex-to-concave interface and enable slidable open-close functionality of the linearly displaceable slider element relative to the lower lid construction;

the linearly displaceable slider element being resiliently actuable when seated atop the lower lid construction within the linear insert-receiving formation for enhancing seated engagement therebetween;

the linearly displaceable slider element comprising an edge-located step-down formation, the edge-located step-down formation being cooperable with resilient actuation of the linearly displaceable slider element for further enhancing seated engagement between the linearly displaceable slider element and the lower lid construction;

the linear insert-receiving formation comprises an element-receiving groove, the edge-located step-down formation being received in the element-receiving groove and directing force into the element-receiving groove from resilient return of the resilient actuation of the linearly displaceable slider element for enhancing contact pressure between the linearly displaceable slider element and the lower lid construction and providing a sealing mechanism;

the linear insert-receiving formation comprising an element-receiving groove, the edge-located step-down formation being received in the element-receiving groove and directing force into the element-receiving groove from resilient return of the resilient actuation of the linearly displaceable slider element for enhancing contact pressure between the linearly displaceable slider element and the lower lid construction and providing a sealing mechanism;

the upper concave surfacing at the linear insert-receiving formation comprising a first radius of curvature and the lower convex surfacing of the linearly displaceable slider element comprising a second radius of curvature, the second radius of curvature being greater than the first radius of curvature when the linearly displaceable slider element is in a relaxed configuration, the second radius of curvature approximating the first radius of curvature when the linearly displaceable slider element is resiliently actuated for exerting pressure into the element-receiving groove.

2. A container lid assembly for a liquid container, the container lid assembly comprising:

a lower lid construction and a displaceable slider element, the lower lid construction comprising an insert-receiving formation and a liquid outlet, the displaceable slider element being receivable in the insert-receiving formation and displaceable relative to the lower lid construction for opening and closing the liquid outlet;

the lower lid construction further comprising upper concave surfacing at the insert-receiving formation and the displaceable slider element comprises lower convex surfacing, the displaceable slider element being seatable atop the lower lid construction within the insert-receiving formation such that the lower convex surfacing and upper concave surfacing form a radiused convex-to-concave interface and enable slidable open-close functionality of the displaceable slider element relative to the lower lid construction;

the displaceable slider element being resiliently actuable when seated atop the lower lid construction within the linear insert-receiving formation for enhancing seated engagement therebetween;

the displaceable slider element comprises an edge-located step-down formation, the edge-located step-down formation being cooperable with resilient actuation of the displaceable slider element for further enhancing seated engagement between the displaceable slider element and the lower lid construction;

the insert-receiving formation comprising an element-receiving groove, the edge-located step-down formation being received in the element-receiving groove and directing force into the element-receiving groove from resilient return of the resilient actuation of the displaceable slider element for enhancing contact pressure between the displaceable slider element and the lower lid construction;

the upper concave surfacing at the insert-receiving formation comprising a first radius of curvature and the lower convex surfacing of the displaceable slider element comprising a second radius of curvature, the second radius of curvature being greater than the first radius of curvature when the displaceable slider element is in a relaxed configuration, the second radius of curvature approximating the first radius of curvature when the displaceable slider element is resiliently actuated for exerting pressure into the element-receiving groove.

3. A container lid assembly for a liquid container, the container lid assembly comprising:

a lower lid construction and a slider element, the lower lid construction comprising an insert-receiving formation and a liquid outlet, the slider element being receivable in the insert-receiving formation and linearly slidable relative to the lower lid construction for opening and closing the liquid outlet;

the lower lid construction further comprising upper concave surfacing at the insert-receiving formation and the slider element comprises lower convex surfacing, the slider element being seatable atop the lower lid construction within the insert-receiving formation such that the lower convex surfacing and upper concave surfacing form a radiused convex-to-concave interface and enable slidable open-close functionality of the slider element relative to the lower lid construction;

the slider element being resiliently actuable when seated atop the lower lid construction within the insert-receiving formation for enhancing seated engagement therebetween;

the slider element comprising an edge-located step-down formation, the edge-located step-down formation being cooperable with resilient actuation of the slider element for further enhancing seated engagement between the slider element and the lower lid construction;

the insert-receiving formation comprisings an element-receiving groove, the edge-located step-down formation being received in the element-receiving groove and directing force into the element-receiving groove from resilient return of the resilient actuation of the slider element for enhancing contact pressure between the slider element and the lower lid construction;

the upper concave surfacing at the insert-receiving formation comprising a first radius of curvature and the lower convex surfacing of the slider element comprising a second radius of curvature, the second radius of curvature being greater than the first radius of curvature when the slider element is in a relaxed configuration, the second radius of curvature approximating the first radius of curvature when the slider element is resiliently actuated for exerting pressure into the element-receiving groove.

4. The container lid assembly of claim 1 wherein the liquid outlet comprises a peripheral raised portion, the peripheral raised portion for exerting pressure against the linearly displaceable slider element when the linearly displaceable slider element is in a closed configuration.

5. The container lid assembly of claim 2 wherein the liquid outlet comprises a peripheral raised portion, the peripheral raised portion for exerting pressure against the displaceable slider element when the displaceable slider element is in a closed configuration.

6. The container lid assembly of claim 3 wherein the liquid outlet comprises a peripheral raised portion, the peripheral raised portion for exerting pressure against the slider element when the slider element is in a closed configuration.

* * * * *